US005479695A

United States Patent [19]

Grader et al.

[11] Patent Number: 5,479,695

[45] Date of Patent: Jan. 2, 1996

[54] METHOD OF MAKING A MULTILAYER MONOLITHIC MAGNETIC COMPONENT

[75] Inventors: Gideon S. Grader, Haifa, Israel; David W. Johnson, Jr., Pluckemin, N.J.; Apurba Roy, Rockwall, Tex.; John Thomson, Jr., Spring Lake, N.J.

[73] Assignee: AT&T Corp., Murray Hill, N.J.

[21] Appl. No.: 270,197

[22] Filed: Jul. 1, 1994

Related U.S. Application Data

[62] Division of Ser. No. 695,653, May 2, 1991, Pat. No. 5,349, 743.

[51] Int. Cl.[6] ..... H01F 41/02

[52] U.S. Cl. ..... 29/602.1; 264/58; 264/61; 336/200; 336/233

[58] Field of Search ..... 29/602.1, 605, 29/606; 336/200, 233; 264/58, 61

[56] References Cited

U.S. PATENT DOCUMENTS

| | | |
|---|---|---|
| 4,322,698 | 3/1982 | Takahashi et al. . |
| 4,388,131 | 6/1983 | Unger et al. . |
| 4,583,068 | 4/1986 | Dickens et al. . |
| 4,620,916 | 11/1986 | Zwemer et al. . |
| 4,731,297 | 3/1988 | Takaya . |
| 4,837,659 | 6/1989 | Roshen et al. . |
| 4,862,129 | 8/1989 | Roshen et al. . |
| 4,880,599 | 11/1989 | Charles et al. . |
| 4,922,156 | 5/1990 | Turcotte et al. . |
| 4,959,631 | 9/1990 | Hasegawa et al. . |

OTHER PUBLICATIONS

"Multilayer Ceramic Packaging Alternatives", by John L. Sprague, IEEE Transactions on Components, Hybrids and Manufacturing Technology, vol. 13, No. 2, Jun. 1990.

"Recent Topics in Soft Ferrites", by K. Okutani et al., International Conference on Ferrites, ICE 5 Jan. 1989.

*Primary Examiner*—Carl E. Hall

*Attorney, Agent, or Firm*—Alfred G. Steinmetz

[57] ABSTRACT

Magnetic components are fabricated as monolithic structures using multilayer co-fired ceramic tape techniques. Fabrication of these magnetic components involves constructing multiple layers of a magnetic material and an insulating non-magnetic material to form a monolithic structure with well defined magnetic and insulating non-magnetic regions. Windings are formed using screen printed conductors connected through the multilayer structure by conducting vias.

33 Claims, 19 Drawing Sheets

METHOD OF MAKING A MULTILAYER MONOLITHIC MAGNETIC COMPONENT

This is a division of application Ser. No. 07/695,653 filed May 2, 1991, now U.S. Pat. No. 5,349,743.

FIELD OF THE INVENTION

This invention relates to a process of making magnetic components and to a physical structure of magnetic components made by the process and, in particular, to monolithic composite magnetic components.

BACKGROUND OF THE INVENTION

Static magnetic devices such as transformers and inductors are essential elements in circuits requiring energy storage and conversion, impedance matching, filtering, EMI suppression, voltage and current transformation, and in resonant circuits. These devices, as now constructed, tend to be bulky, heavy and expensive as compared to the other components of the circuit. Their cost tends to be dominated by construction costs since manual operations still form a part of the production process for many of these components.

No widely used method of constructing and fabricating magnetic components has resulted in any radically new and different magnetic component structure. The current methods of manufacturing magnetic components have not changed significantly from the traditional methods involving the mechanical process of wrapping a copper wire around a magnetic core material or around an insulating former (i.e. bobbin) containing core material. Hence, despite the trend towards low profiles and and miniaturization in other electronic components, and the trend to integration and other circuit packaging techniques, the magnetic components in current use generally retain traditional constructions.

Recent approaches to changing the construction of magnetic components have included layered or drop-in windings as opposed to wound windings such as disclosed in U.S. Pat. No. 4,583,068. These techniques have introduced new mechanical construction methods to significantly reduce hand operations and construction costs.

Another recent approach to magnetic component design is a multilayer chip inductor using thick film technology and designed as a surface mount component. This approach is disclosed in an article entitled "Recent Topics in Soft Ferrites" by K. Okutani et al presented at The Int Conf. on Ferrites, ICF 5, January (1989). The magnetic component designated, a "chip type" inductor or transformer, is constructed by a sequence of thick film screen print operations to build up layers on an individual layer by layer basis, which are then fused by co-firing. This process, which uses printed layers of ferrite paste and conductor paste (for the windings) is limited to the use of a single material as both the magnetic and insulating material. This use of a single material limits the choice of materials to those having a relatively high resistivity such as CuNiZn ferrite material which, however, has which, however, has a low permeability and low breakdown voltage capability. The process is also limited to certain geometries. Additionally, because of the absence of suitable non-magnetic inclusions in the construction process, the net magnetic flux produced by the electrical excitation of the winding is not fully coupled to each turn of the winding. In the transformer case, this leads to a leakage inductance capability inferior to that of transformers made by traditional construction techniques.

SUMMARY OF THE INVENTION

Magnetic components are fabricated, in accord with the invention, as monolithic structures using multilayer co-fired ceramic techniques. In one process for constructing a magnetic component, embodying the principles of the invention, a first ceramic powder having the desired magnetic characteristics (e.g. high permeability) is prepared and a second ceramic powder having the desired insulating and nonmagnetic characteristics (i.e. low permeability) is prepared. The term nonmagnetic material as used herein refers to a material whose magnetic permeability is low compared to that of the magnetic material used in the component. At least one ceramic powder is admixed with an organic binder to form a ceramic green tape. At least one ceramic powder can be doped with suitable metallic oxides for the purpose of adjusting its sintering rate and temperature to substantially equal that of the other ceramic powder. A structure is formed by successive layering of the insulating nonmagnetic material and combining it with the magnetic material to form a structure with well defined magnetic and insulating nonmagnetic regions. Conductors, having a composition compatible with these materials, are screen printed on the layers of the insulating non-magnetic ceramic green tape as needed to provide windings for electromagnetic excitation of the magnetic ceramic material. The resulting structure is laminated under low pressure (500–3000 psi) at a temperature of 60 to 80 degrees centigrade and the laminated structure is fired at a temperature between 800 to 1400 degrees centigrade to form the resulting composite structure of the magnetic component.

Advantages offered by the use of two separate materials for the magnetic and insulating non-magnetic portions of structures constructed according to the principles of the invention include: (i) the magnetic flux can be substantially confined to a well defined path or region, part of which is completely encircled by the windings. This enables both a flux coupling to each turn of the windings and a leakage inductance capability that equal those of conventional magnetic components. (ii) the choice of magnetic material can be made on the basis of required magnetic performance, and is not restricted only to magnetic materials with high resistivity.

Magnetic ceramic green tape or paste material and insulating non-magnetic ceramic green tape or paste materials, modified according to the principles of the invention, so that both materials have substantially identical sintering temperatures, shrinkage rates and overall shrinkage results, are selected to permit the use of co-firing techniques in the construction of the magnetic components. In one illustrative embodiment a high permeability material in ceramic green tape form, comprising a MnZn ferrite with spinel structure, is used as the magnetic material and a high resistivity and low permeability Ni ferrite material with spinel structure in ceramic green tape form is used as the insulating nonmagnetic material. The low permeability Ni ferrite material is doped with copper (Cu) and manganese (Mn) to secure the desired operative characteristics needed to permit construction by co-firing techniques. This use of two ferrite based isostructural materials for both high permeability and low permeability materials provides the necessary material compatibility to allow the application of co-firing techniques in the construction of the magnetic component.

In this particular illustrative example, fabrication of these magnetic components involves constructing multilayers of insulating non-magnetic material as a ceramic tape combined with a ceramic magnetic material in tape form. Apertures are formed in the insulating non-magnetic ceramic tape material into which a magnetic ceramic tape is inserted. Conductor lines are screen printed on the insulating non-magnetic ceramic tape material and interconnected through vias to form windings around the magnetic tape inserts. In another version, the apertures are included in the magnetic ceramic tape structure for accepting inserts of insulative non-magnetic ceramic tape.

In another illustrative example, fabrication of these magnetic components involves constructing multilayers of insulative non-magnetic material as a ceramic tape including apertures for accepting a ceramic magnetic material in a viscous fluidlike form. This material may be a screen printable paste composition. In another version, a magnetic ceramic tape material includes apertures for accepting an insulative non-magnetic material in a viscous fluidlike form.

In another illustrative embodiment of the invention, a magnetic component may be constructed using a ceramic tape material having both magnetic and high resistivity properties (e.g. NiZn ferrite). Conductors are printed on the various layers and connected through conducting vias to form windings. In transformer applications the leakage inductance is limited by enclosing the adjacent portions of separate windings within a insulative non-magnetic material (tape/paste). Another version uses two green tape materials, such as described above, and further uses a paste material (either magnetic or insulative) as magnetic or insulative inserts as required for the component structure. In all cases, the windings are formed using screen printed conductors which are connected through the multilayer structure by conducting vias.

Additional characteristics of the materials must be accommodated in the construction of these magnetic components. For example, in some embodiments, where the via spacing determines winding pitch, the via size and hence spacing is constrained by the tape thickness used. A thick magnetic tape needed to provide a desired magnetic characteristic or performance requires construction of a large via size in the insert of insulating non-magnetic tape. This via size limits, the number of windings permitted within a particular linear dimension. The winding pitch is therefore limited to a dimension dictated by the thickness of the magnetic material. Winding pitch, in some of the illustrative embodiments, is harmonized with the magnetic material (fluxpath) thickness requirement to achieve suitable proportions of the conductor winding pitch by multilayering the construction of the insulating non-magnetic inserts with thin strips of ceramic tape. This building up of thin layers to form a single insert permits the construction of vias of small diameter to permit a desired winding pitch while allowing the desired magnetic material thickness to provide the desired fluxpath.

While the illustrative embodiments described above have been denoted in terms denoting stand alone magnetic components, these magnetic components may be embedded within a general purpose multilayer substrate constructed using the insulative non-magnetic tape material. Part of the substrate would contain at least one magnetic component and its remaining portion would be used to provide interconnection for high density component mounting on the surface.

These methods of construction permit fabrication of magnetic components having electromagnetic performance characteristics equaling or exceeding those of magnetic components made with traditional construction techniques, while providing the advantages of low profiles, miniaturization, integration, and low-cost mass production.

DETAILED DESCRIPTION

Co-fired multi layer construction has been found to be increasingly competitive with the traditional thick film technology in the fabrication of microelectronic circuit packages. These co-fired multilayer packages are constructed by using unfired green (dielectric) ceramic tape for the various layers. Compatible conductive compositions are used for printed conductor layers interspersed between the dielectric layers and are also used for interlayer connecting vias. The conductive layers are normally printed on the green tape and the entire assembly is laminated and fired in one operation. Its chief advantages are the ability to reduce the physical size of circuitry and improve its reliability.

Successful fabrication of these packages requires that the materials used be fully compatible with each other. During sintering of the ceramic tape composite, for example, the various layers must shrink at a rate compatible with each other to prevent warpage of the package. Each of the layers must be chemically compatible with each other to prevent chemical reactions resulting in various defects in the final package. Various physical properties such as thermal expansion and flexure strength of the different layers must also be taken into account.

These construction techniques have been limited heretofore to circuit substrates with associated conducting paths to interconnect mounted components. Constructing magnetic components using co-fired multilayer ceramic construction with two different materials of different permeability has not been done before. Both materials must have similar sintering characteristics. Such a construction process must also successfully deal with critical material composition problems including electrical and physical compatibility of magnetic, insulating non-magnetic and conducting materials. Material shrinkage, thermal shock resistance, thermal. expansion and durability are added considerations in the construction of these co-fired multilayered magnetic components.

Figure 1:
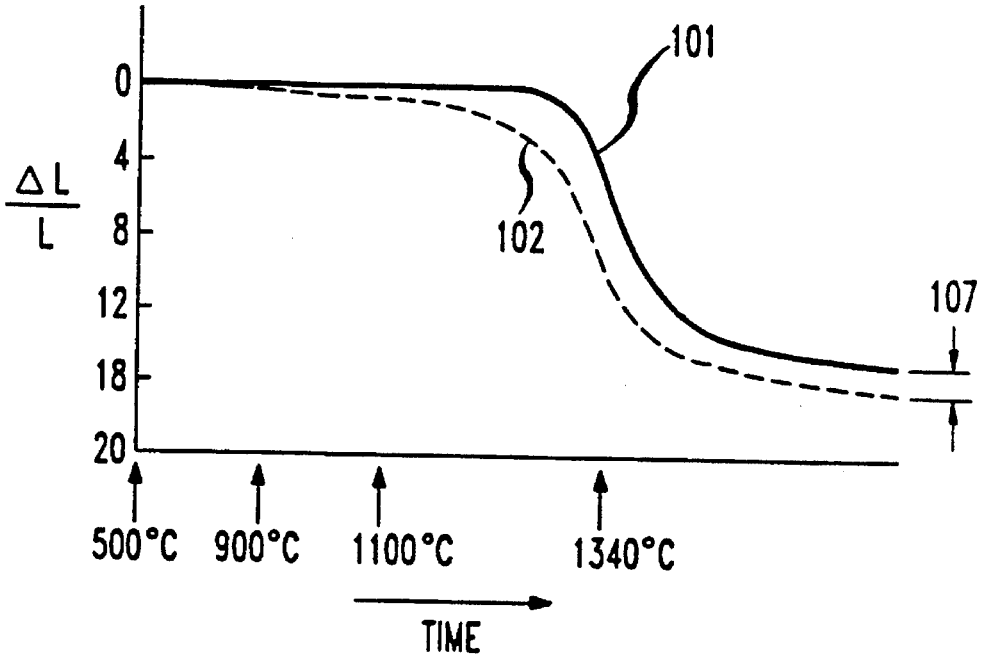
FIG. 1 is a sintering rate and temperature diagram for two dissimilar ferrite materials being processed by sintering.

The effect of the differing sintering characteristics is shown in FIG. 1. FIG. 1 shows the sintering rate and temperature of two ferrite materials with different magnetic and electric properties. The solid line 101 depicts the densification as a function of increasing temperature and time of a Ni ferrite—an insulating non-magnetic (low permeability) material. These sintering characteristics differ from the dotted line curve 102 of a MnZn ferrite—a magnetic (high permeability) material. As is apparent the differing sintering rates and temperatures cause the two materials to shrink at different rates. This divergence continuously widens and the MnZn ferrite material achieves a high shrinkage before the Ni ferrite material. The final size of the two materials at the end of processing differs considerably by the value shown by dimension 107 in FIG. 1.

Other material related problems arise in those embodiments of a composite monolithic magnetic component, wherein interconnecting conductive vias form a portion of the windings. Conflicting construction requirements of the vias and thickness of the layers could result in undesirable component characteristics such as the winding pitch and fluxpath length that would render such magnetic components made by co-fired multilayer construction techniques inferior in magnetic performance as compared to traditional magnetic components.

An illustrative process embodying the principles of the invention for constructing magnetic components using a ceramic tape material for the magnetic portion of the structure and a ceramic tape material for the insulating non-magnetic portion. These ceramic materials are spinel ferrites of the form $M_{1+x}Fe_{2-y}O_{4-z}$. The values for x, y, and z may assume both positive and negative numerical values. The M material normally includes at least one of the elements Mn, Ni, Zn, Fe, Cu, Co, Zr, Va, Cd, Ti, Cr and Si. Both of these materials (insulating non-magnetic-low permeability and magnetic-high permeability) must have the desired physical and electrical properties to facilitate the construction of a suitable magnetic component. One ceramic tape material is used for the high permeability magnetic structure of the component and another ceramic tape material is used for the low permeability structure of the component. Two ferrite based powders form the basic material of each of the insulative non-magnetic and magnetic tape materials. The first ferrite powder, in the illustrative example, is formulated as a MnZn ferrite (e.g. a high permeability material). A second ferrite powder, in the illustrative example, is formulated as a high resistivity low permeability Ni ferrite material. The two powders are each separately combined with organic binders to formulate a first and second ceramic green tape material respectively. To insure that the two tape materials have substantially identical sintering temperatures and rates the low permeability material including Ni ferrite is doped with copper oxide in an amount equaling 1 to 10 mol % of the overall composition of the material. In the particular illustrative embodiment, herein, a percentage of 2 to 5 mol % of copper oxide added to the Ni ferrite powder has been found to be effective. Adding the copper oxide introduces a liquid phase into the material during sintering of the tape material. This operative condition lowers the sintering temperature and modifies its sintering rate to a level where the high permeability and low permeability material each have substantially identical sintering rates and temperatures.

Figure 2:
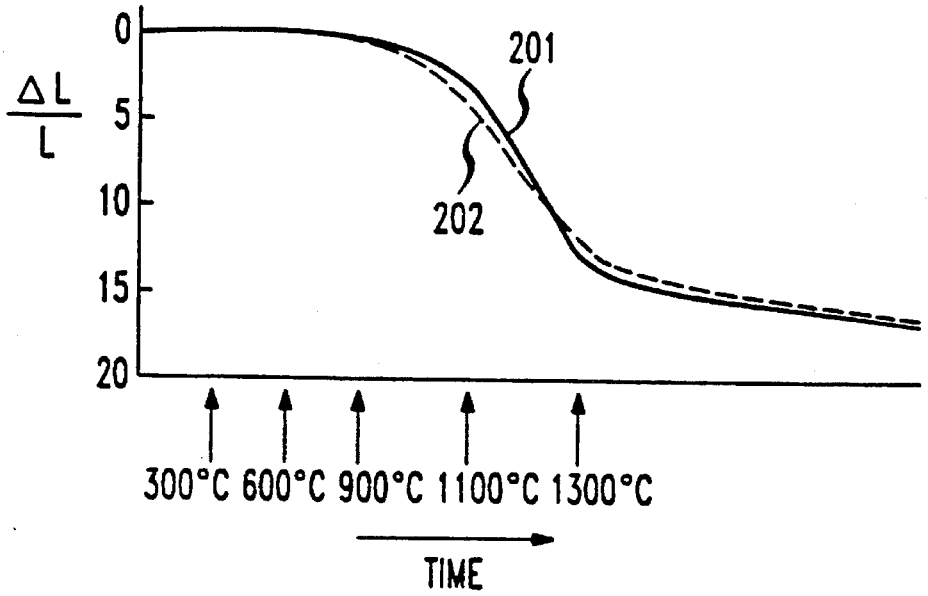
FIG. 2 is a sintering rate and temperature diagram for two dissimilar ferrite materials being processed wherein at least one of the materials is composed according to the principles of the invention.

The effect of matching the sintering rates and temperatures is shown in the graph of FIG. 2 wherein the solid line 201 represents the sintering characteristic of the high permeability MnZn ferrite material. The corresponding characteristic of the NiCu ferrite material is shown by the dotted line 202. As is apparent the two characteristic lines are substantially identical to each other. The substantially identical shrinkage rates and temperature allow the two materials to be co-fired without introducing mechanical stresses that would prevent the forming of the composite structure.

Pluralities of the two ceramic green tape materials are layered with a desired geometry to form a laminated structure with well defined magnetic and nonmagnetic regions. Conducting paths are deposited on selected insulating non-magnetic tape layers. These conducting paths are connected by vias formed in the layers to create desired multiturn windings for the magnetic component.

The conducting paths in the illustrative embodiments are constructed of a conductive material that is amenable to printing or other deposition techniques and is compatible with the firing and sintering process characteristics of the ferrite materials. Suitable conductive materials include palladium (Pd) or palladium-silver compositions (Pd-Ag) dispersed in an organic binder. Other suitable compositions include conductive metallic oxides (in a binder) which have the same firing and sintering characteristics as the ferrite materials used in constructing the magnetic devices.

The structure formed by the layering technique is laminated under pressure and then co-fired and sintered at a temperature of 1100 to 1400 degrees Centigrade to form a monolithic magnetic component structure having the desired electrical and magnetic properties.

To increase electrical resistivity and further reduce the low permeability of the second tape material, the Ni ferrite powder material is doped with Mn to a. content equaling 1–10 mol % of the overall material composition.

Figure 3:
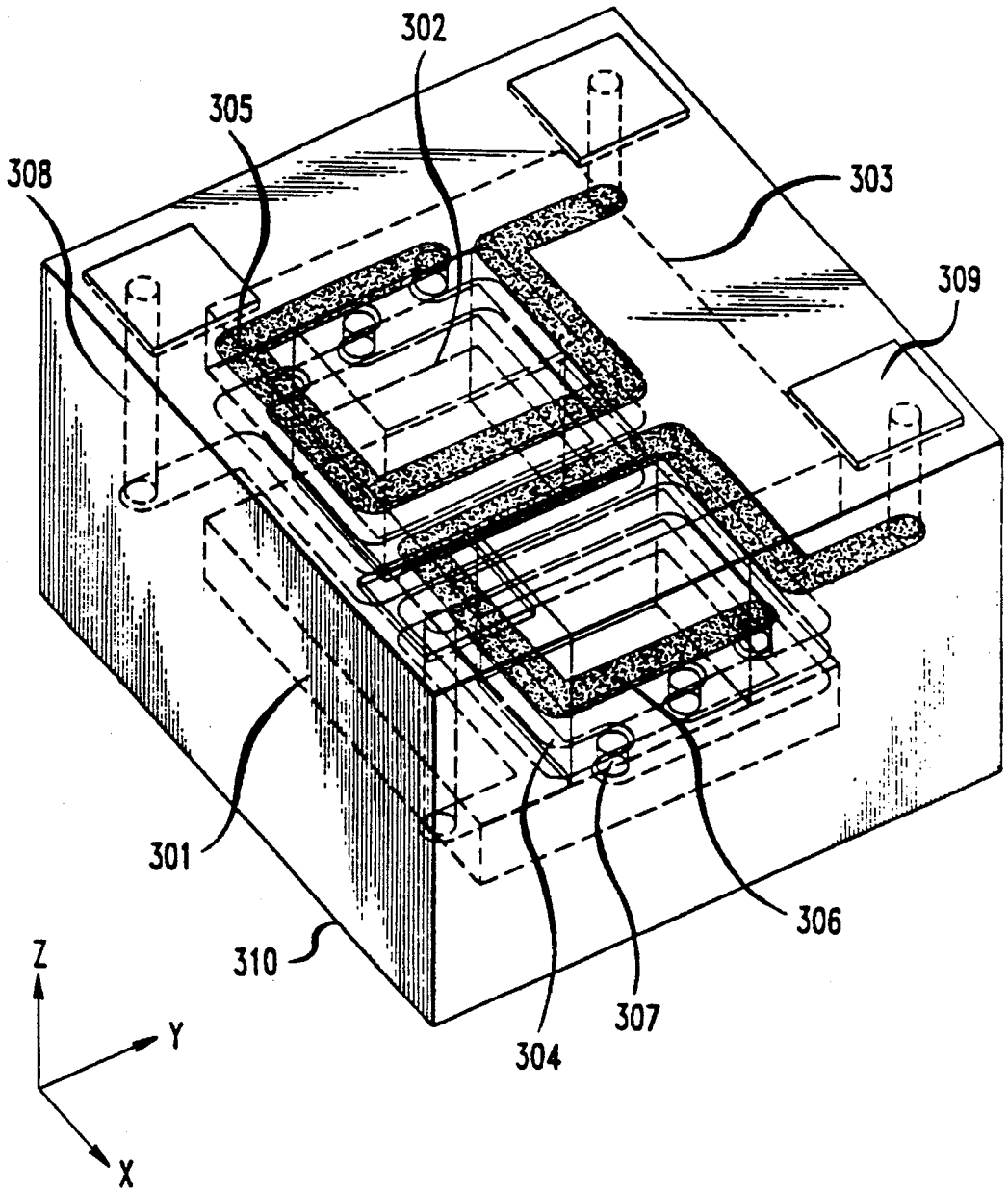
FIG. 3 is a three dimensional see through line drawing of a completed composite magnetic component structure.

A see through pictorial view of an illustrative magnetic component constructed according to the principles of the invention is shown in FIG. 3. This component is constructed as a multiple winding transformer having a toroidal magnetic core structure. This toroidal core comprises four well defined sections 301 to 304 each of which is constructed from a plurality of high permeability ceramic green tape layers. Sections 302 and 304 are circumscribed by conductive windings 305 and 306, respectively. Taken separately these windings form the primary and secondary of a transformer. [If these windings are connected in series, the structure functions as a multiple turn inductor.] Windings 305 and 306 are formed by screen printing pairs of conductor turns on to a plurality of insulating non-magnetic ceramic green tape layers, each insulating non-magnetic layer having suitable apertures for containing the sections of magnetic green tape layered inserts. The turns printed on each layer are connected to turns of the other layers with conductive vias 307 (i.e. a through hole filled with a conductive material). Additional insulating non-magnetic layers are used to contain sections 301 and 303 of the magnetic tape sections and to form the top and bottom structure of the component. Conductive vias 308 are used to connect the ends of the windings 305 and 306 to connector pads 309 on the top surface of the component. The insulating non-magnetic regions of the structure are denoted by 310. Current excitation of the windings 305 and 306 produces a magnetic flux in the closed magnetic path defined by the sections 301–304 of the toroidal core. The fluxpath in this embodiment is in a vertical plane. [The X-Z plane shown in FIG.3.]

Figure 4:
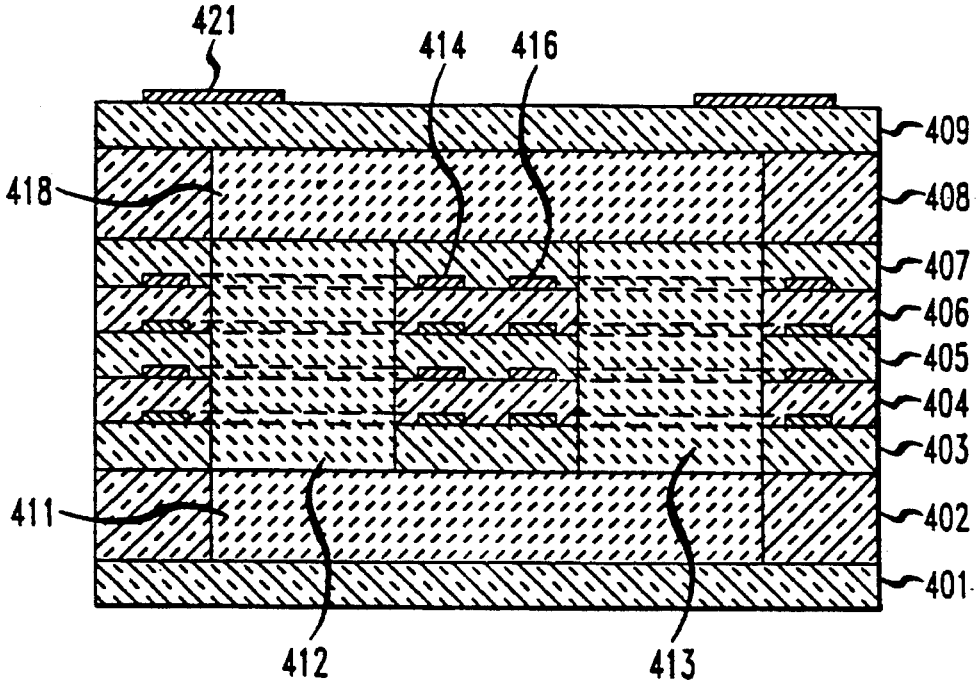
FIG. 4 is a cross sectional view of the composite magnetic component structure of FIG. 3.
Figure 13:
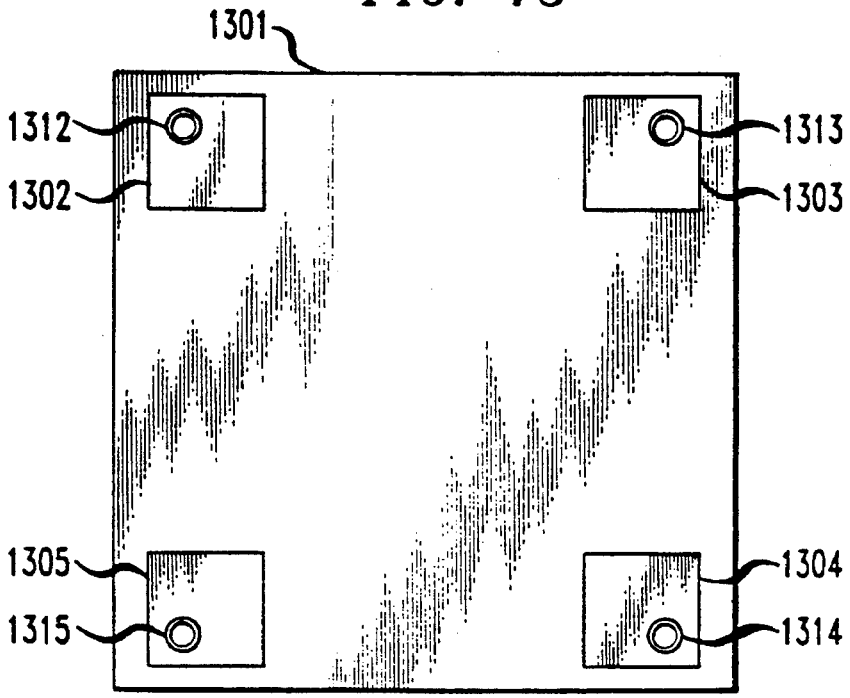
FIGS. 5–13 are planar views of the individual layers of the magnetic component structure of FIG. 3.

A cross sectional view (parallel to the X-Z plane) showing in detail the individual tape layers of the magnetic component structure of FIG. 3 is disclosed in FIG. 4. Member 401 is an insulating non-magnetic tape layer. Member 402 includes layers of non-magnetic tape each having an aperture in which a magnetic section 411 (shown as member 301 in FIG. 3) is inserted. The number of layers used to form members 402 and 411 is determined by the required magnetic cross section area. Members 403–407 forming the next section includes single layers of insulating non-magnetic tape having apertures for containing magnetic material sections 412 and 413 (shown as members 302 and 304 in FIG. 3). Members 403 to 406 contain conductor turns 414 and 416 printed on each individual layer. In this particular illustration a four turn winding is shown. It is to be understood that many added turns are possible by increasing the number of layers and by printing multiple concentric turns on each layer. Member 408 is similar to member 402 and includes an insulating non-magnetic tape having an aperture containing a magnetic insert. 418. The top member 409 is an insulating non-magnetic tape layer. Connector pads 421 are printed on the top surface to facilitate electrical connection to the windings of the component.

Figure 5:
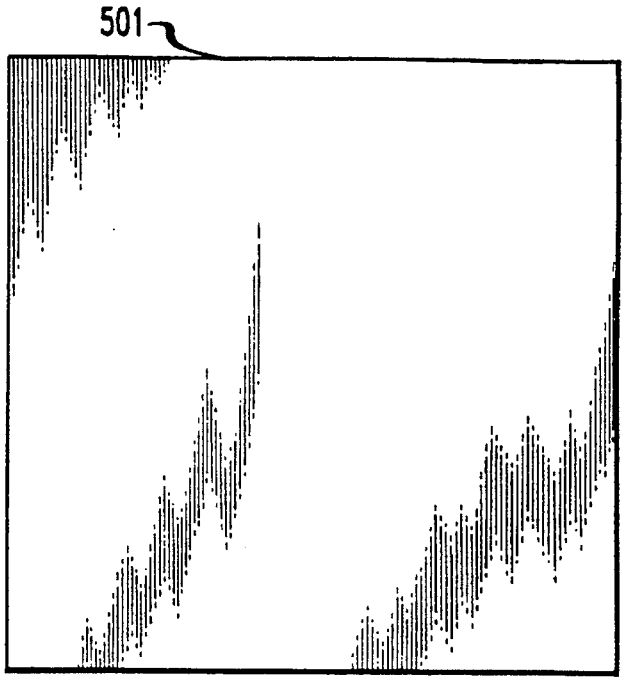
Figure 6:
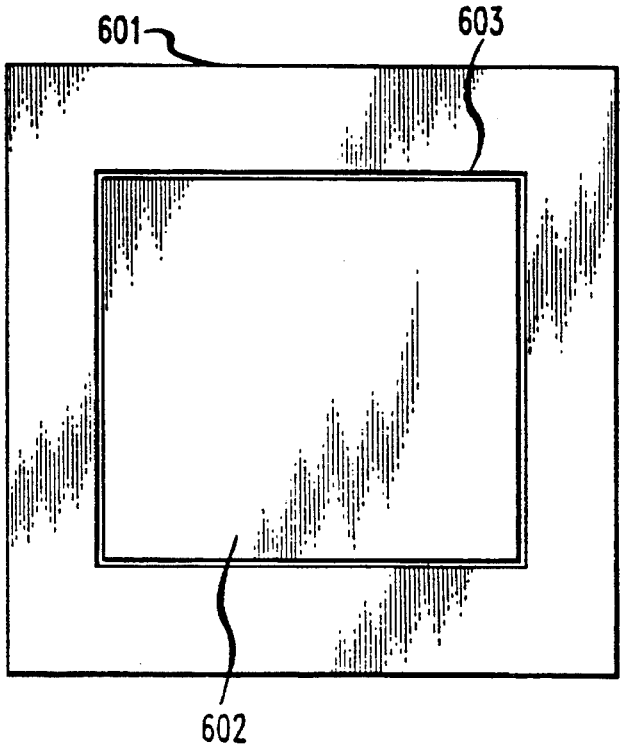
Figure 7:
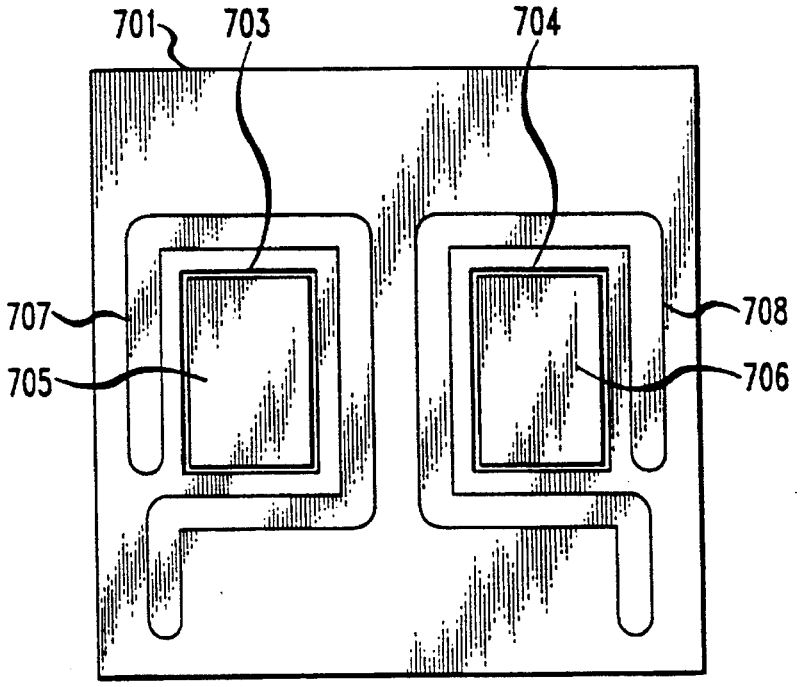
Figure 8:
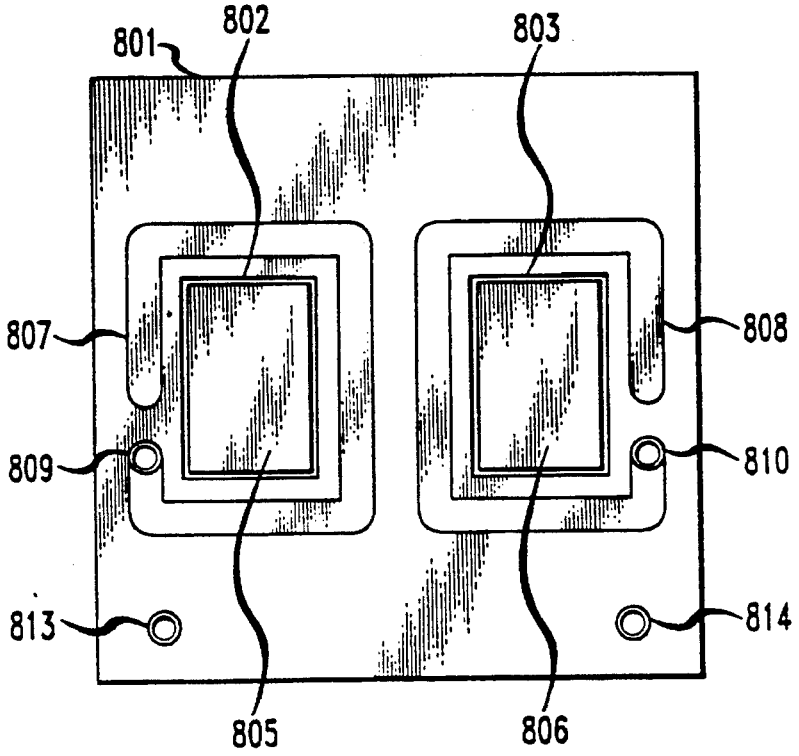
Figure 9:
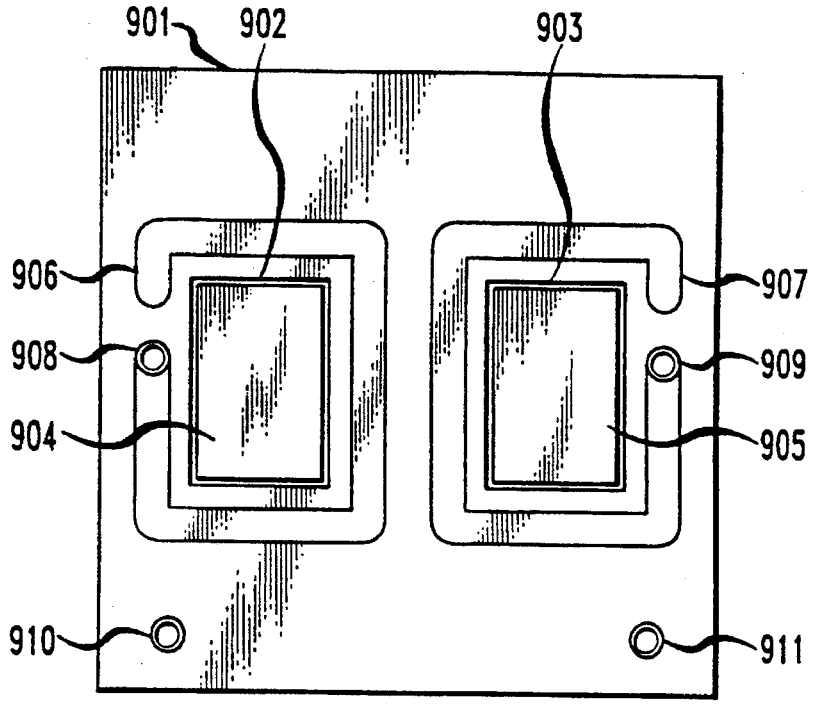
Figure 10:
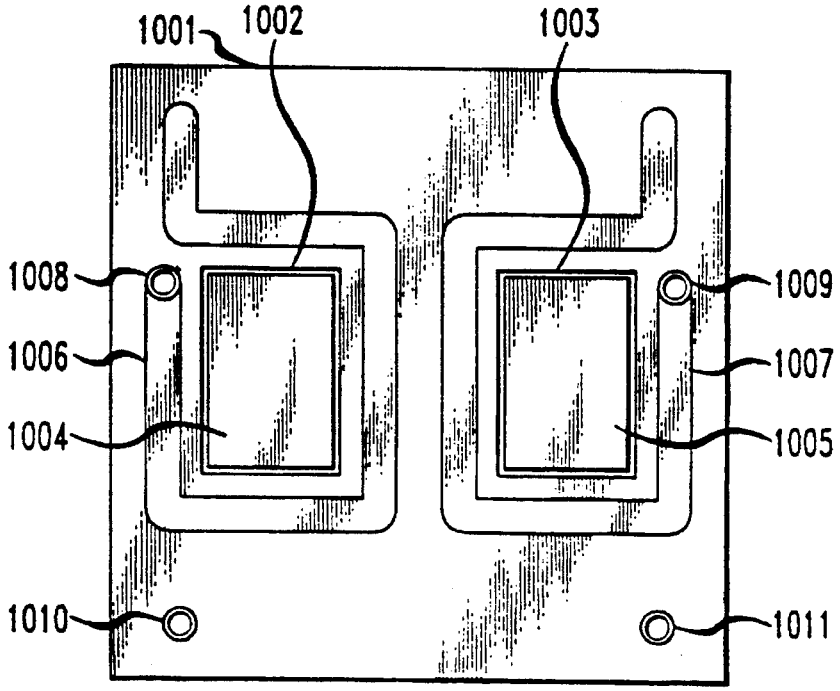
Figure 11:
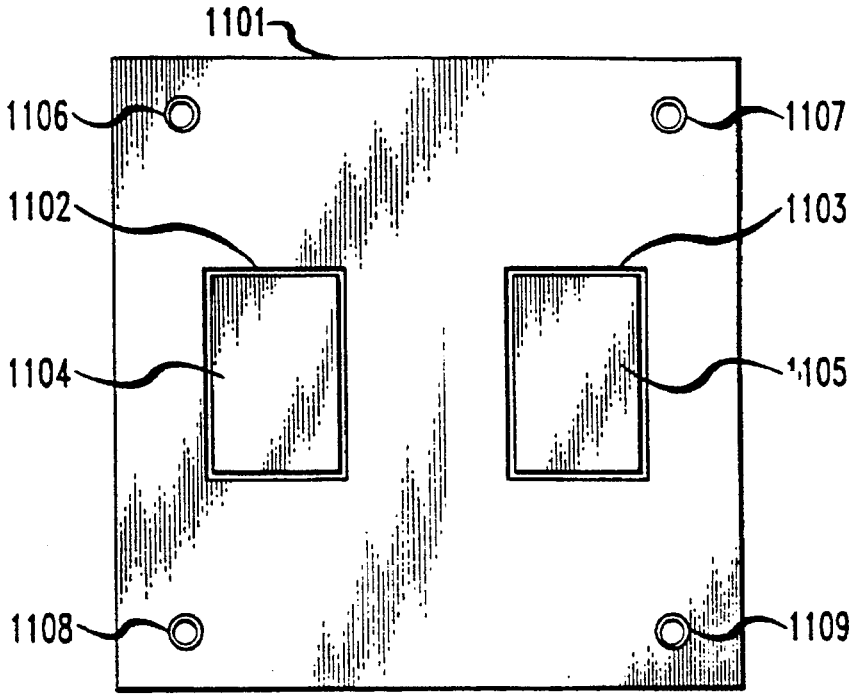
Figure 12:
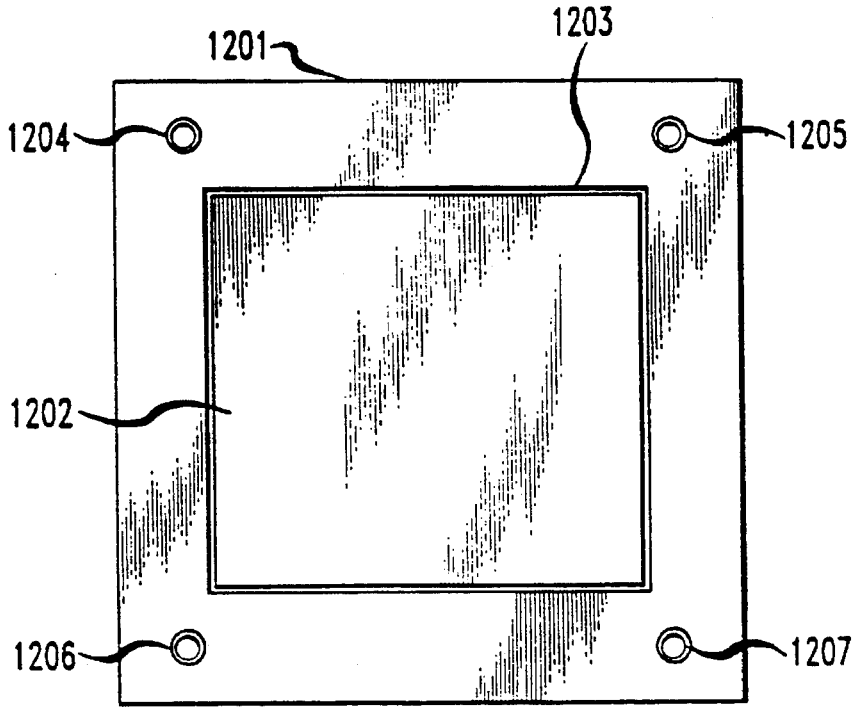

The individual layers are shown in the FIGS. 5 through 13. FIG. 5 shows the bottom member as an insulating non-magnetic layer 501. FIG. 6 shows a top view of the next member above layer 501 and comprises an insulating non-magnetic tape 601 with an aperture 603 containing an insert 602 of magnetic tape material. This member may comprise several tape layers determined by the required magnetic cross section. The next member in the structure is shown in FIG. 7 and comprises the insulating non-magnetic tape layer 701 containing the apertures 703 and 704 into which magnetic inserts 705 and 706 are placed. Conductors 707 and 708 are printed onto the top surface of the tape layer 701. These conductors 707 and 708 comprise a single turn each of the transformer windings (shown as windings 305 and 306 in FIG. 3). A single turn is shown surrounding each aperture; however multiple turns surrounding each aperture may be printed on each layer. An insulating non-magnetic layer 801 shown in FIG. 8 comprises the next structural member and includes apertures 802 and 803, containing magnetic inserts 805 and 806. The conductors 807 and 808 are the second set of turns in the windings. They are connected by vias 809 and 810 to the first set of turns printed on the previous layer shown in FIG. 7. The vias 813 and 814, which have ring like pads on the surface of layer 861, connect to the other ends of the windings on the layer 701 and correspond to similar vias in the above layers to connect to connector pads on the top surface of the structure shown in FIG. 13. The ring like pads surrounding the vias are included to simplify the alignment of vias in the various layers. FIG. 9 shows the construction of the next member and includes a insulating non-magnetic tape layer 901; the apertures 902 and 903 containing magnetic tape inserts 904 and 905 and the conductors 906 and 907. The conductors 906 and 907 are the third set of turns in the windings and are connected by vias 908 and 909 to the second set of turns shown in FIG. 8. Vias 910 and 911 connect to the vias 813 and 814 shown in FIG. 8. The next member shown in FIG. 10 includes an insulating non-magnetic tape layer 1001 with two apertures 1002 and 1003 including magnetic inserts 1004 and 1005. The winding turns are the fourth set of turns and include the conductors 1006 and 1007. The vias 1008 and 1009 connect these conductors to the conductors of the previous layer of FIG. 9. Vias 1010 and 1011 are part of the conductive path coupling the conductors of the bottom layer with the connector pads on the top surface of the structure. This is the last layer including the windings. It is to be understood that the number of turns is illustrative only and that the structures may contain many additional turns. The member illustrated in FIG. 11 includes an insulating non-magnetic layer 1101 with apertures 1102 and 1103 containing magnetic tape inserts 1104 and 1105. Conducting vias 1106 and 1107 connect to the conductors shown in FIG.10 and conducting vias 1108 and 1109 are part of the conductive path coupling the conductors of the bottom layer with the connector pads on the top surface of the structure. This member of FIG. 11 is operative to insulate the conductor windings from the next member shown in FIG. 12. This member is similar to the member shown in FIG. 6 and includes a set of insulating non-magnetic tape layers 1201 each of which include an aperture 1203 containing the magnetic inserts 1202. In addition, this member includes the conducting vias 1204, 1205 1206 and 1207 connected to the corresponding vias of the adjacent members. The top member, shown in FIG. 13, includes an insulating non- magnetic layer 1301 and connector pads 1302 to 1305 each containing a conductive via 13 12 to 1315, respectively, which provide connection to the corresponding vias in the previous member of FIG. 12.

Figure 14:
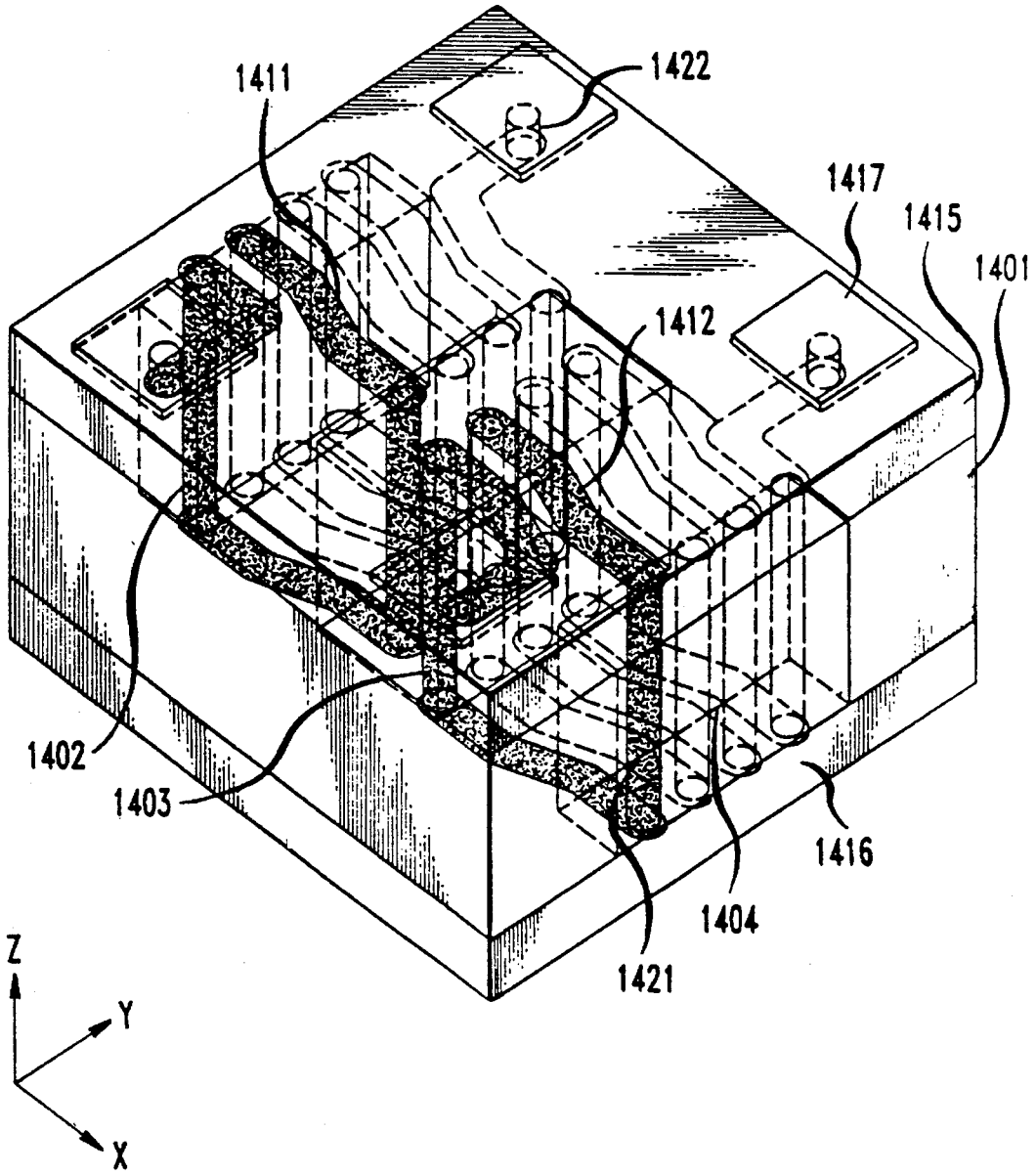
FIG. 14 is a three dimensional see through line drawing of a completed composite magnetic component component structure.

A see through pictorial view of another illustrative magnetic component constructed according to the principles of the invention is shown in FIG. 14. This component, as in the case with the prior example, is also constructed as a multiple winding transformer having a toroidal magnetic core structure. A major difference from the embodiment of FIG. 3 is that the flux path is horizontal [i.e in the X-Y plane]. The toroidal core is defined by a main structure of magnetic material 1401 positioned between top and bottom members 1415 and 1416 which are insulating non-magnetic material layers. Member 1401 is further punctuated by inserts of insulating non-magnetic material inserts 1402, 1403 and 1404 which provide support for conducting vias 1421 which form part of the windings. The windings 1411 and 1412 are the primary and secondary, respectively, of the transformer. Windings 1411 and 1412 may be connected in series to form an inductor. These windings are formed by screen printing conductors on a layer of member 1415 near the top of the structure and screen printing conductors on a layer of member 1416 near the bottom of the structure and interconnecting these printed conductors with the conducting vias 1421 to form the windings. Connector pads 1417 are printed on the top surface of the top layer of member 1415 and are connected by conducting vias 1422 to the windings 1411 and 1412.

Figure 15:
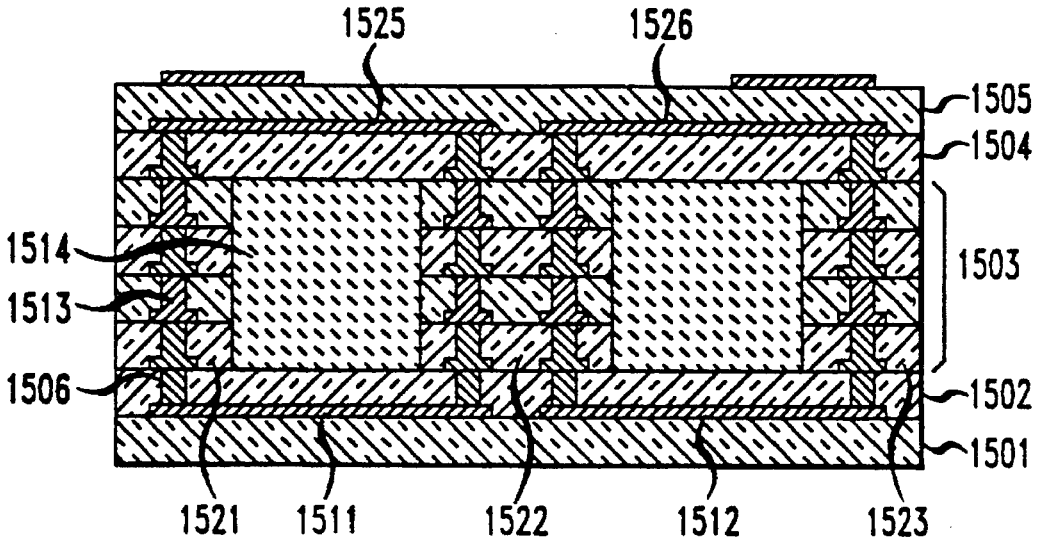
FIG. 15 is a cross sectional view of the composite magnetic component structure of FIG. 14.

A cross sectional view (parallel to the X-Z plane) of the structure of FIG. 14 is shown in FIG. 15 and shows in detail the individual tape layers. The bottom and top members 1501 and 1505 each comprise insulating non-magnetic tape layers. Member 1501 has conductors 1511 and 1512 screen printed on its upper surface. Member 1502 has conducting vias 1506 to connect the printed windings of 1501 to a series of conducting vias 1513 that eventually connect to printed conductors 1525 and 1526 printed on the top surface of the insulating non-magnetic tape member 1504. Member 1503 comprises a plurality of magnetic tape layers 1514 (or a single magnetic tape layer of appropriate thickness) and insulating non-magnetic inserts 1521 to 1523 formed from a plurality of insulating non-magnetic layers including the series of conducting vias 1513. These inserts 1521 to 1523 are called via carriers herein and are operative to support the conducting vias.

Figure 16:
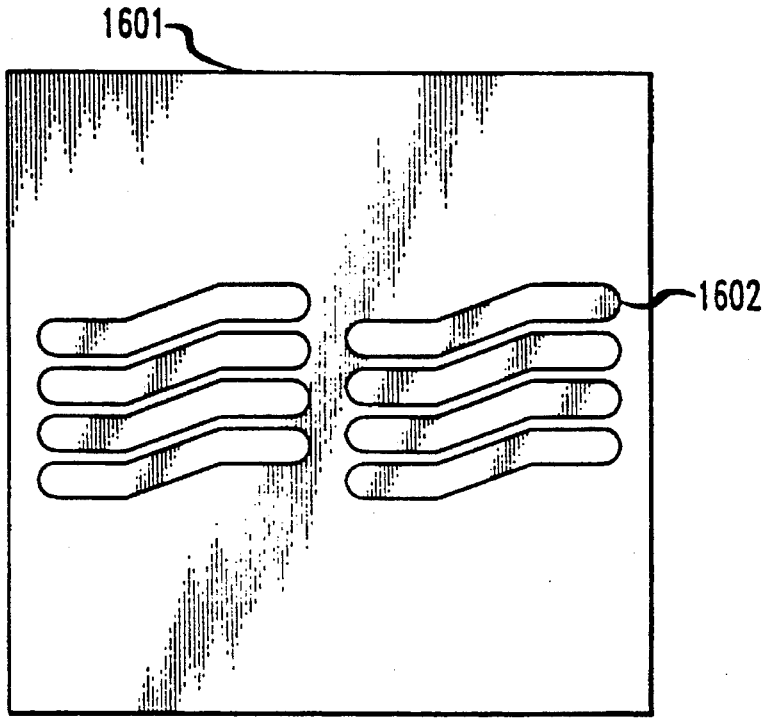
FIGS. 16–20 are planar views of the individual layers of the magnetic component structure of FIG. 14.
Figure 17:
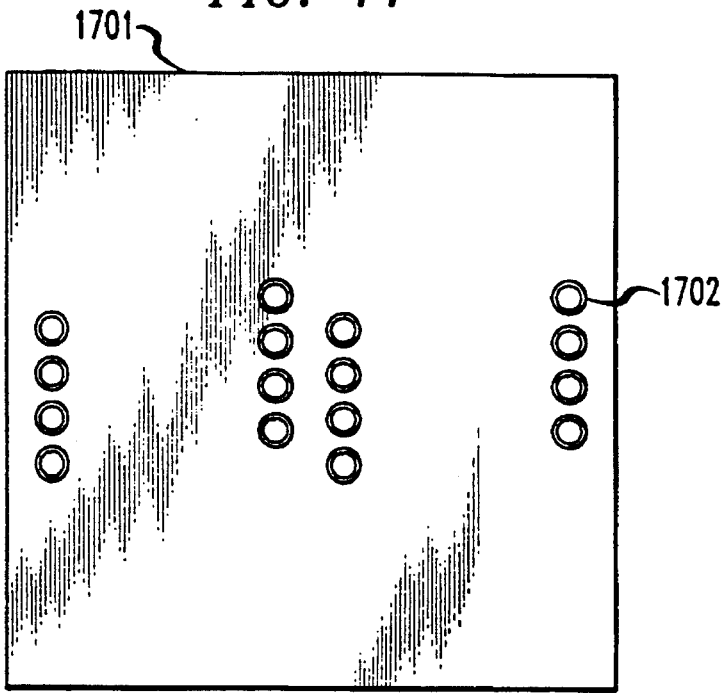
Figure 18:
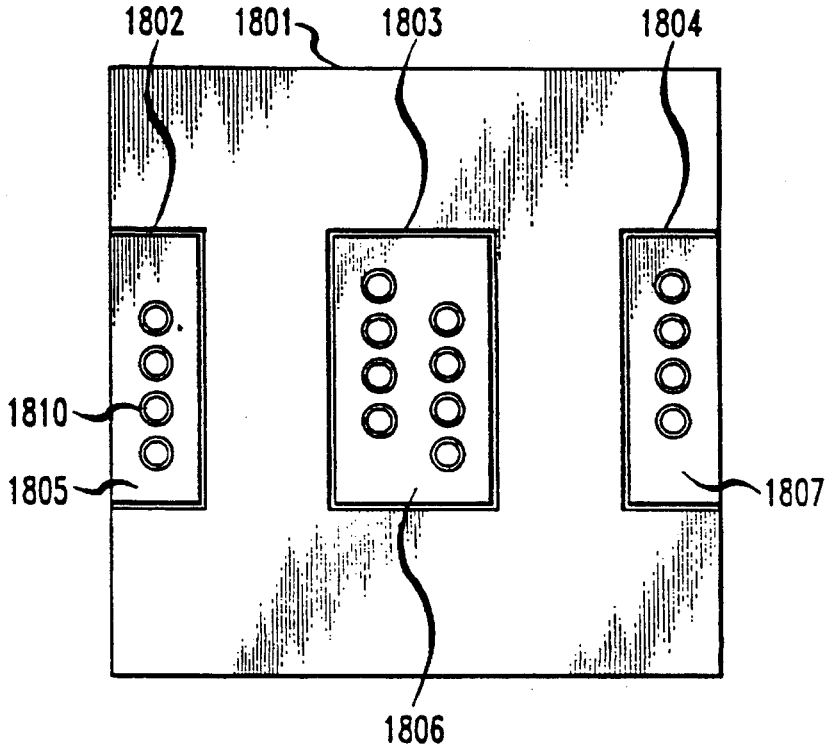
Figure 19:
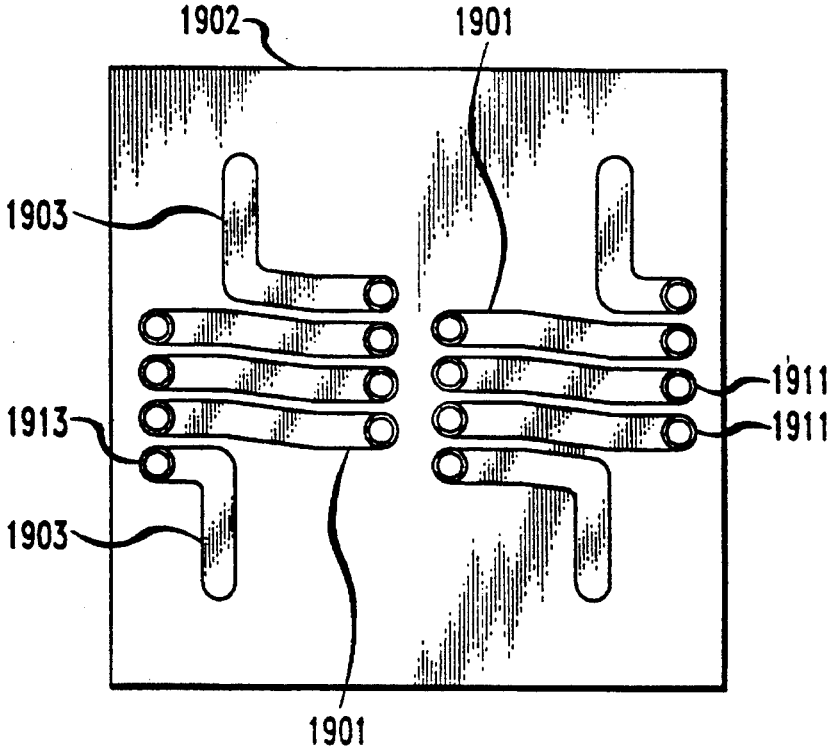
Figure 20:
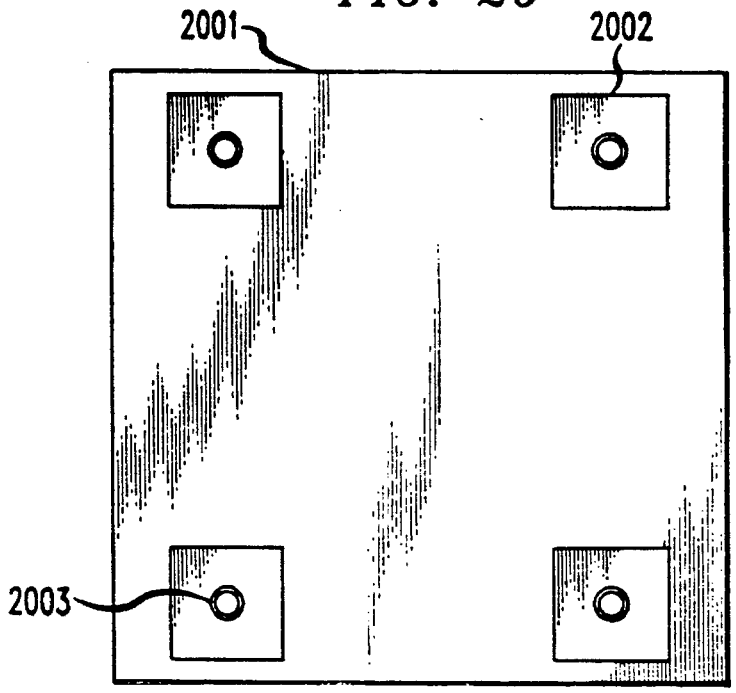

The individual layers are shown in the FIGS. 16 through 20. The first member comprising layer 1501 of FIG. 15 is shown in FIG 16. It includes a layer of insulating non-magnetic tape 1601 on which the conductors 1602 have been screen printed. The next member above it is shown in FIG. 17 and comprises insulating non magnetic tape layer 1701 into which conducting vias 1702 with end ting pads have been constructed. These vias are in registration with the ends of the printed conductors 1602 shown on the layer 1601 in FIG. 16. The next member is shown in FIG. 18 and comprises a layer or layers of magnetic tape 1801 which include the apertures 1802, 1803 and 1804 into which the via carriers 1805, 1806 and 1807 are inserted. These via carriers are formed from a plurality of non-magnetic layers and include the conducting vias 1810. These vias 1810 are in registration with the vias in the different layers and the terminal ends of the printed conductors on the layers in members 1501 and 1504 shown in FIG. 15. The top set of printed conductors 1901 and 1903 are shown in the FIG. 19 and are printed on the top surface of a layer of insulating non-magnetic tape 1902. Both ends of the printed conductors 1901 terminate in conducting vias 19 11 and a single end of the printed conductors 1903 terminates in vias 1913. The vias 1911 and 1913 connect the top and bottom planes of printed conductors. The top member, shown in FIG. 20, comprises a layer of insulating non-magnetic tape 2001 with connecting pads 2002 printed on its top surface. These pads are connected by the conducting vias 2003 to the non via ends of the printed conductors 1903 shown in FIG. 19.

Figure 21:
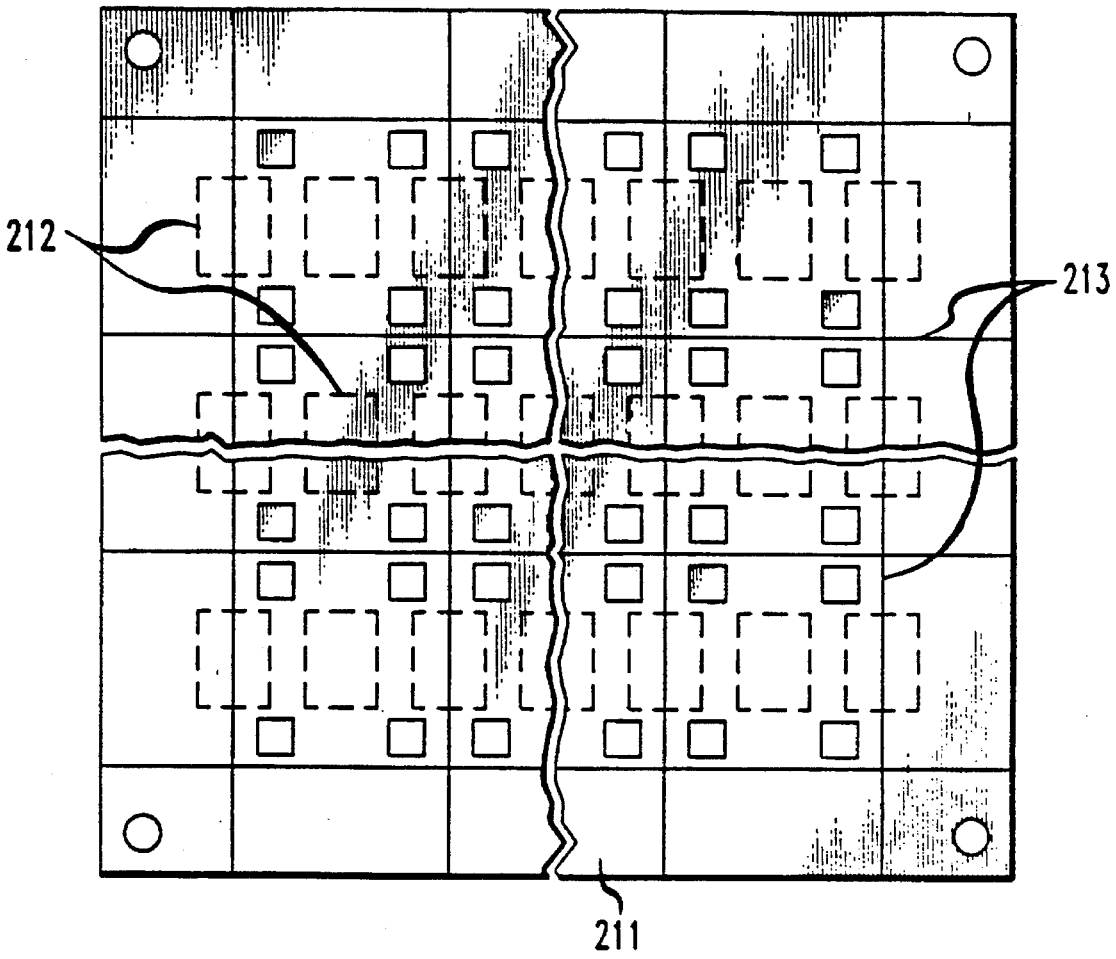
FIG. 21 is a planar view of the top layer of a laminated stack of multiple layers showing multiple magnetic components before dicing.

A method of producing multiple magnetic components in one operation is shown in FIG. 21. A laminated stack 211 of a plurality of layers of insulating non-magnetic tape and magnetic tape is shown with non-magnetic inserts (via carriers) 212 buffed within the stack. The outlines 213 define the multiple individual components which are separated by dicing along these outlines. Each individual component has the structure shown in FIGS. 14–20. These outlined components can be diced out prior to or subsequent to the step of co-firing of the components. This method of producing multiple magnetic components in one operation, through illustrated here only for the structure of FIGS. 14–20, can be applied to any magnetic component constructed according to the principles of the invention.

Figure 22:
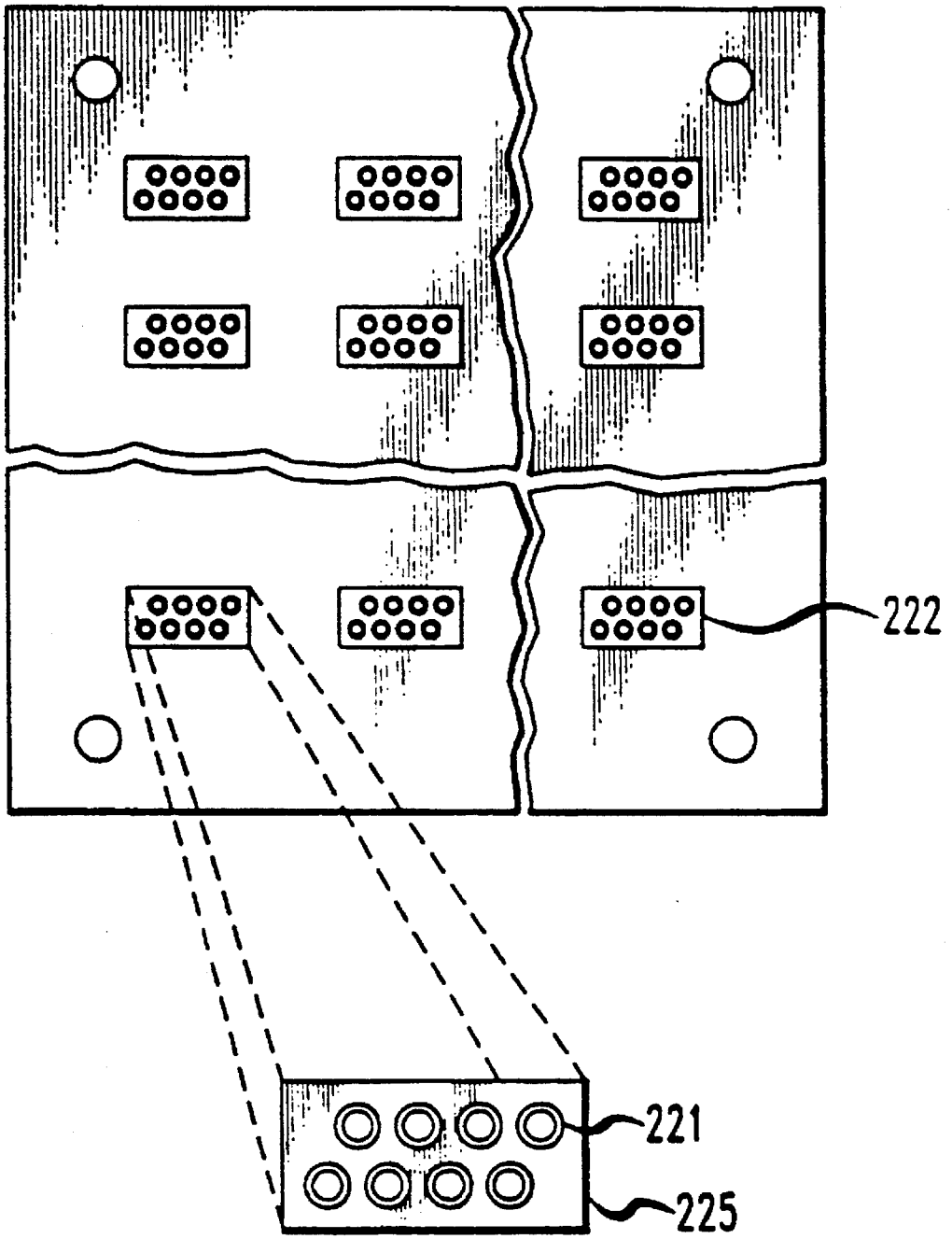
FIG. 22 is a planar view of the top layer of a multilayer stack from which the via carriers of FIG. 18 are punched.
Figure 23:
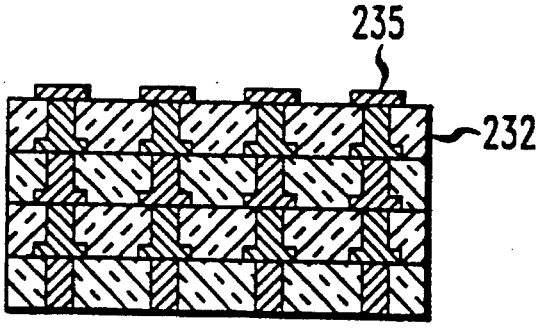
FIG. 23 is a cross sectional view of a via carrier.

The construction of non-magnetic inserts containing vias, or via carriers, is shown in FIGS. 22 and 23. A structure of multiple layers of non-magnetic material is formed. Each layer contains conducting vias 221 in individual blocks defined by the outlines 222. These blocks are punched out to create the individual non-magnetic inserts 225 for constructing the magnetic components.

A cross section of the via carrier construction is shown in FIG. 23. The vias 235 are formed in a laminated stack of tape layers 232. The thinness of the individual layers 232 permits the creation of vias 235 having a diameter sufficiently small to permit a fine winding pitch.

Figure 24:
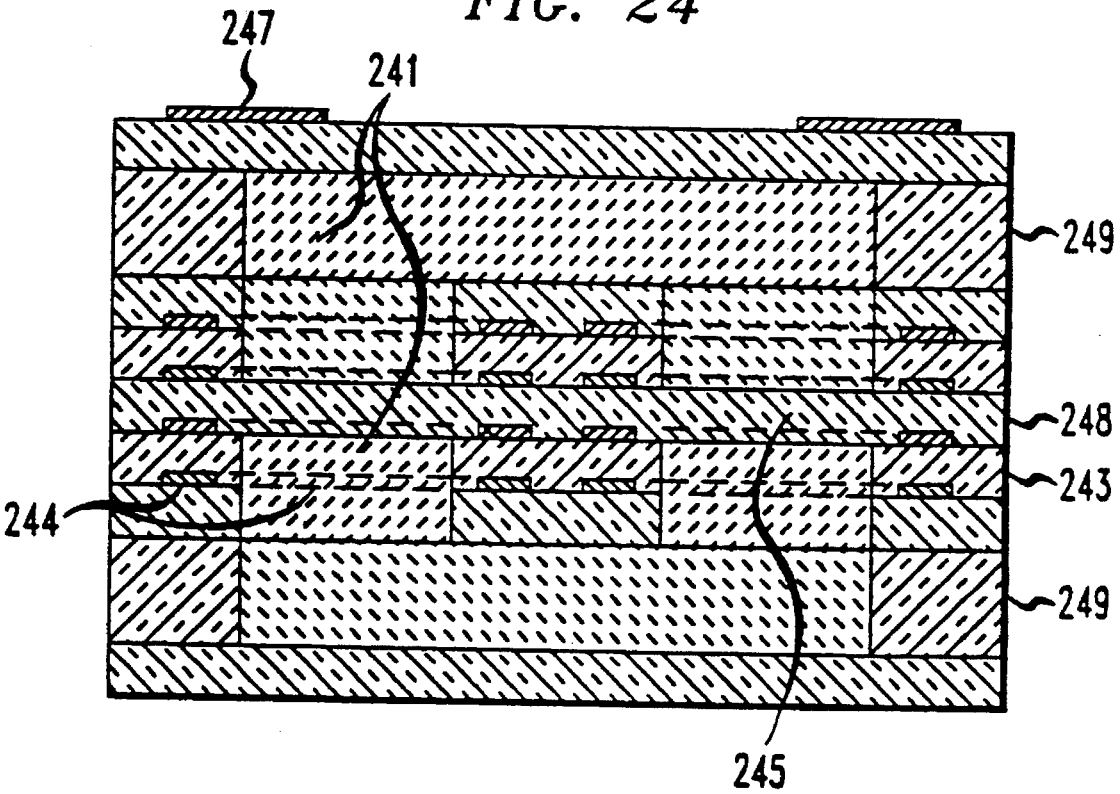
FIGS. 24 to 33 show cross sectional views of magnetic components constructed according to the principles of the invention.

A cross section of a magnetic component having a toroidal magnetic structure with a built in non-magnetic gap in the magnetic fluxpath is shown in FIG. 24. The cross section cut in this view is in the X-Z plane. This arrangement is a vertical structure in which the insert portions 241 are magnetic. The construction of this structure is similar to that of the structure shown in FIGS. 3 and 4, except that the central insulating non-magnetic layer or layers 248 do not have apertures for insertion of magnetic material. The magnetic path defined by the inserts 241 is therefore interrupted by non-magnetic gaps 245, the length of which can be controlled by the layer thickness or number of layers comprising 248. The structure thus constitutes a gapped magnetic structure. The layered insulating portions 243 and 248 of the structure have surface printed conductors 244 comprising the windings of the magnetic component. The members 249 comprise insulating non-magnetic tape layers and, like the structure of FIGS. 3 and 4, provide top and bottom insulative layers and apertures containing portions of the magnetic inserts 241. Connector pads 247, provided on the top surface of the structure, are connected to the conductors 244 through vias which are not shown in this view.

Figure 25:
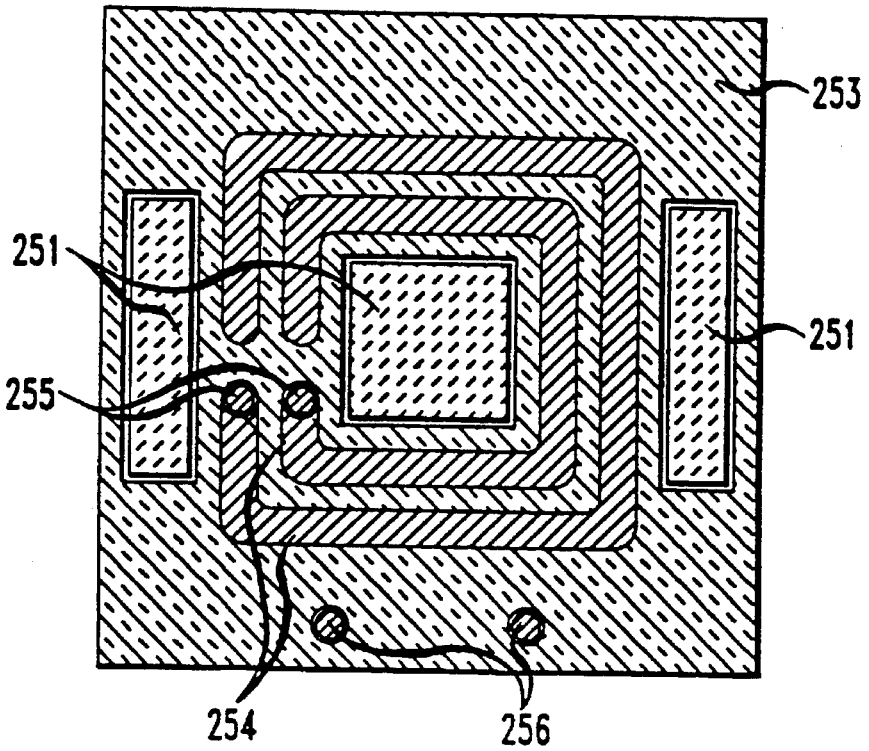

A composite magnetic component structure incorporating a magnetic E core structure is shown in a cross section view in FIG. 25. This cross section view is cut in the X-Y plane. The magnetic insert portions 251 are inserted in apertures in the layered non-magnetic insulating portion 253 and are the core structure that provides the magnetic path for flux. The conductors 254 are printed on the layers of non-magnetic material 253. The vias 255 provide interlayer interconnections, and vias 256 are pan of the conducting path connecting conductors of the bottom layer with the connector pads on the top surface. Unlike conventional E core structures which are comprised of two core halves mated together, the E core structure of FIG. 25 has a magnetic path uninterrupted by mating surfaces. Thus, the effective permeability of the core equals the material permeability. This provides for a significant performance advantage over conventional E core structures wherein the unavoidable non-vanishing air gaps at the making surfaces result in effective permeabilities that can be typically as low as 50% of the material permeability. This performance advantage for magnetic components constructed according to the principles of the invention applies also to all the subsequently described magnetic components that incorporate ungapped core structures.

Figure 26:
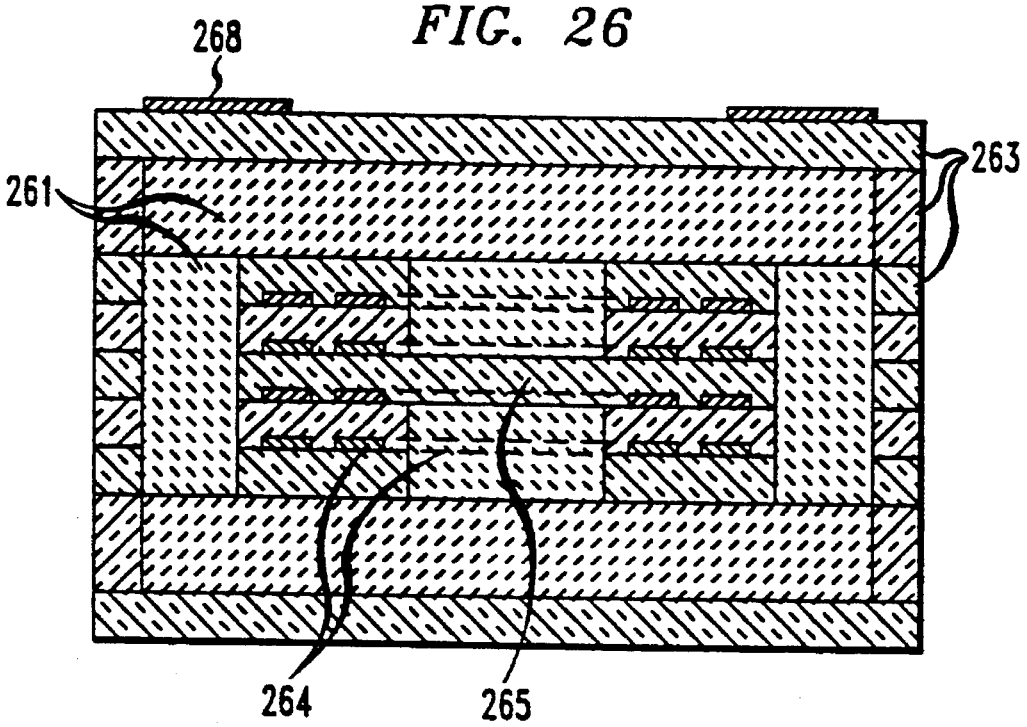

A cross section in the X-Z plane of a magnetic component having an E core structure with a built in gap is disclosed in FIG. 26. The printed conductors 264 forming the windings are printed on selected individual layers of the insulating nonmagnetic layers 263. The non-magnetic gap 265 occurs in the center leg of the E core portion 261 of the structure. The conductors 264 are connected, via vias (not shown) to the connector pads 268 printed on the top of the structure.

Figure 27:
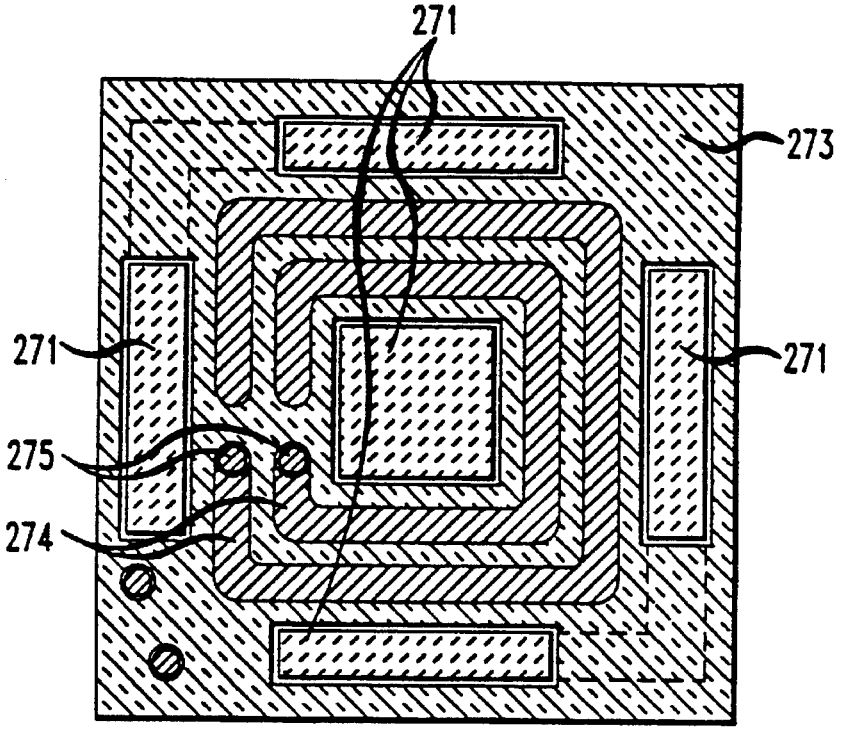

A cross section of a magnetic component incorporating a pot core structure, embodying the principles of the invention, is shown in FIG. 27. This cross section is taken in the X-Y plane. The printed conductors 274 comprising the windings are printed on selected layers of the insulating non-magnetic layers 273. The magnetic material 271 is inserted into apertures of the structure to form the pot core configuration. The conductors of different layers are connected by the vias 275.

Figure 28:
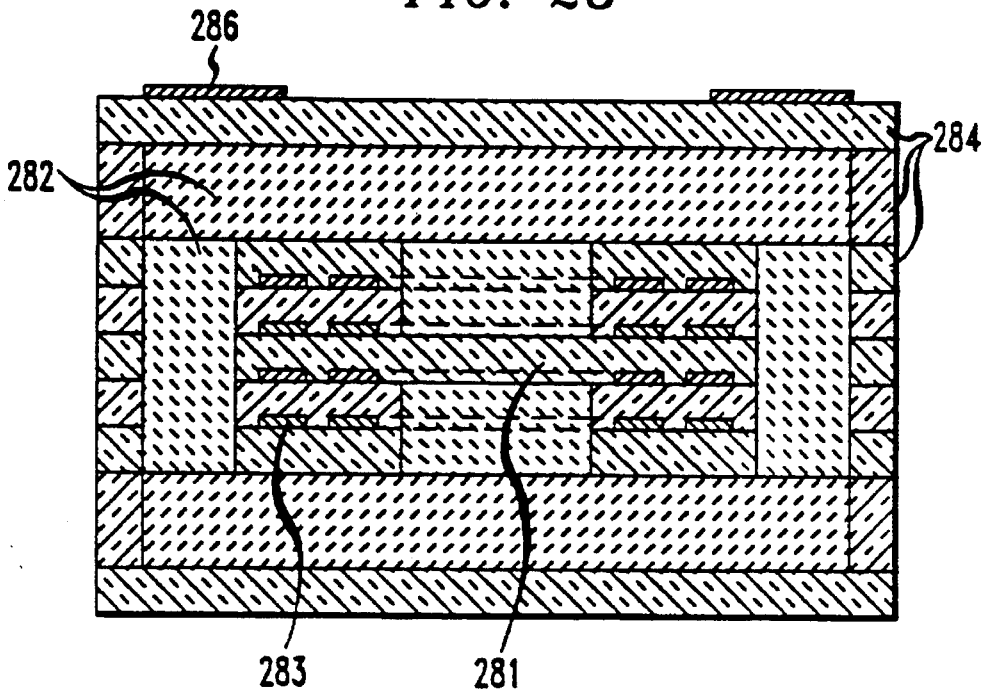

A magnetic component having gapped pot core structure is shown in FIG. 28 with the cross section taken in the X-Z plane. The non-magnetic gap 281 is formed in the central leg of the magnetic material 282 forming the core structure. The conductors 283 forming the windings are printed on selected layers of the insulating non-magnetic material 284 forming the structure. Connector pads 286 are printed on the top surface of the structure and are connected to the conductors 283 via vias (not shown).

Figure 29:
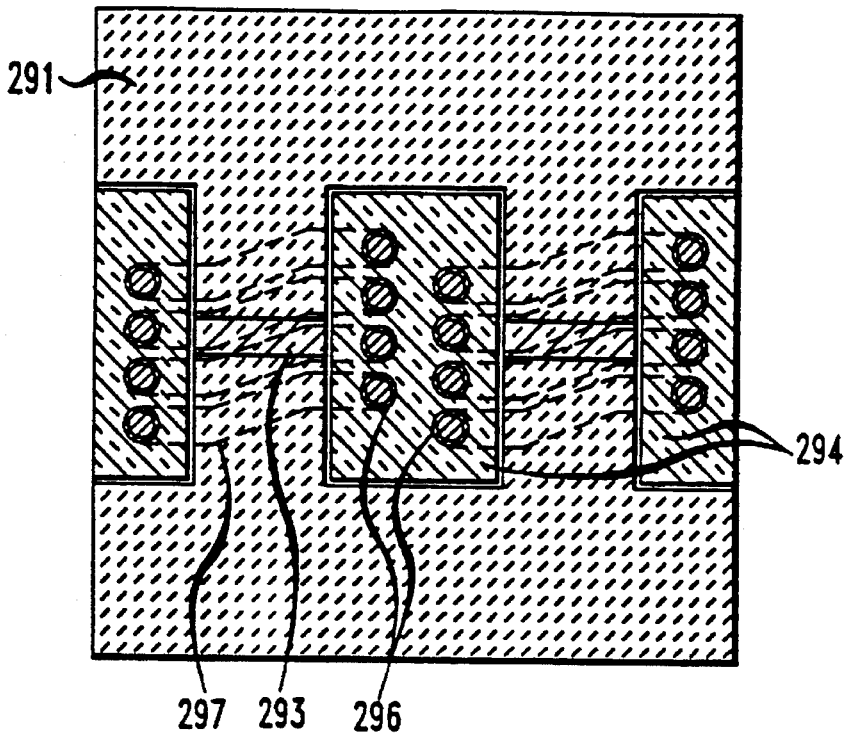

The cross section of an alternative version of a magnetic component incorporating gapped toroidal magnetic structure is shown in FIG. 29. The cross section is taken in the X-Y plane and shows the vias 296 used in conjunction with printed conductors 297 (shown schematically) printed on insulating non-magnetic layers (not shown) to form the magnetic device windings. These vias 296 are formed in the insulating non-magnetic insert portions 294 (via carriers) of the structure. Non-magnetic gaps 293 appear between the two halves of the magnetic core material 291. The gaps also contain insulating non-magnetic inserts to ensure conformal shrinkage.

Figure 30:
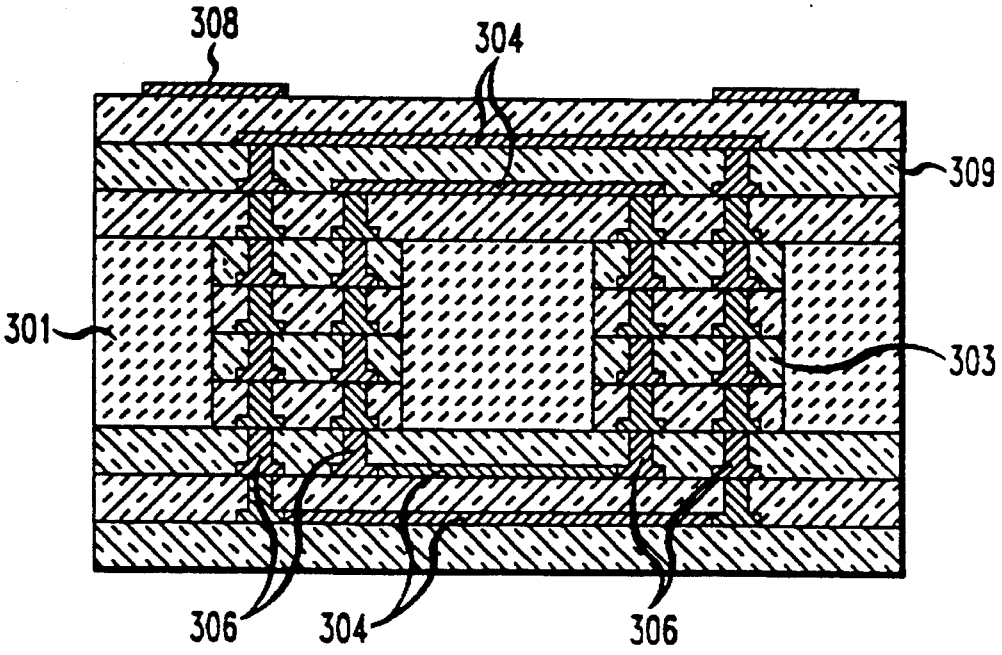

An alternative magnetic component having an E core structure is shown in an X-Z plane cross section in FIG. 30. It has conducting vias 306 formed in the insulating non-magnetic layers 309 and inserted via carriers 303. These vias represent a portion of the device winding. The windings are completed with the printed conductors 304 printed on the insulating material layers 309. The magnetic layers 301 form the magnetic path in the structure. Connector pads 308 are provided on the top surface of the structure.

Figure 31:
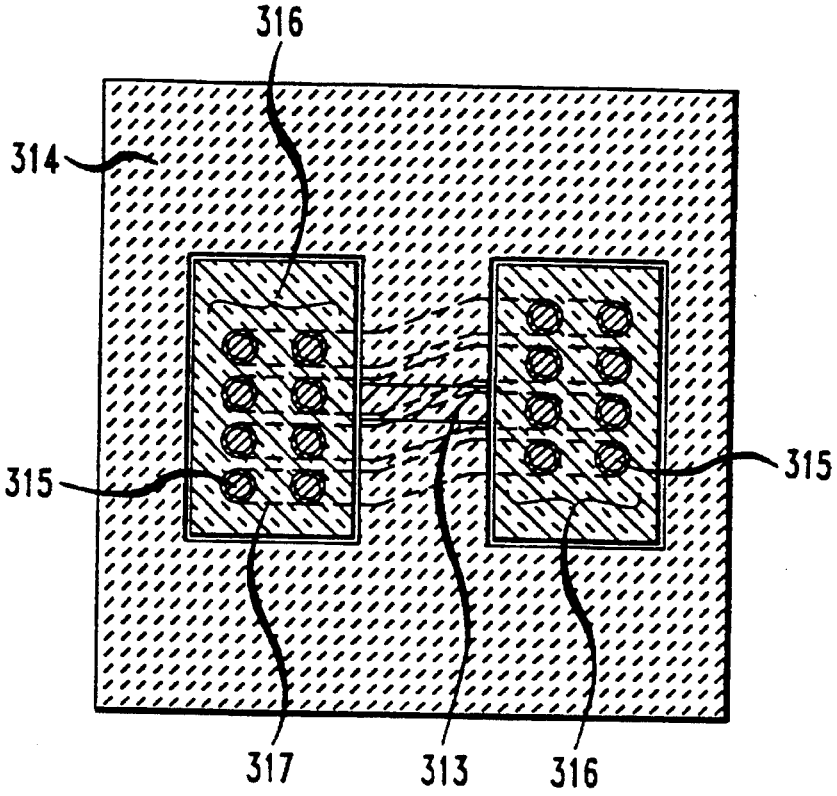

A magnetic component incorporating a gapped E core structure is shown in a cross section view in the X-Y plane in the FIG. 31. This structure utilizes the vias 315 in the insulating non-magnetic inserts 316 and printed conductors 317 (shown schematically) printed on insulating non-magnetic layers (not shown) to form the device windings. A gap 313 appears in the center leg of the magnetic material layers 314 forming the E core. The gap also contains an insulating non-magnetic insert to ensure conformal shrinkage.

Figure 32:
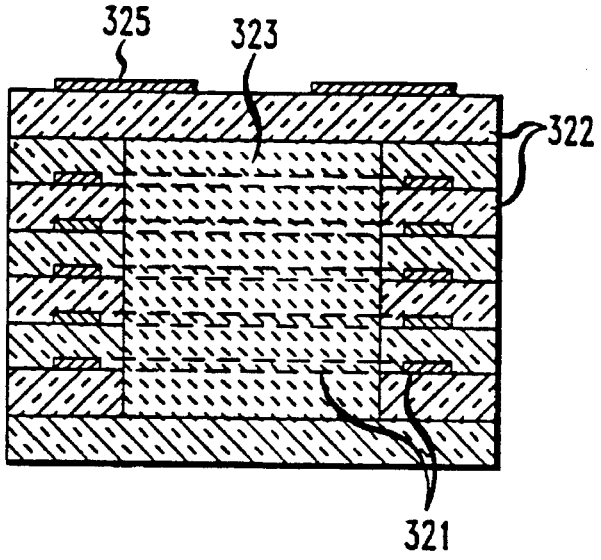

An open structure magnetic device (i.e. a device with an open magnetic circuit) with the cross section taken in the X-Z plane is shown in FIG. 32. Conductor windings 321 are printed on several selected layers of the insulating non-magnetic material 322 to encircle a central core formed of layers of magnetic material 323. Connector pads 325 are printed on the top surface of the structure. It is important for the material 322 to be non-magnetic for this circuit to function as an open magnetic circuit. This applies also to the device of FIG. 33 described below.

Figure 33:
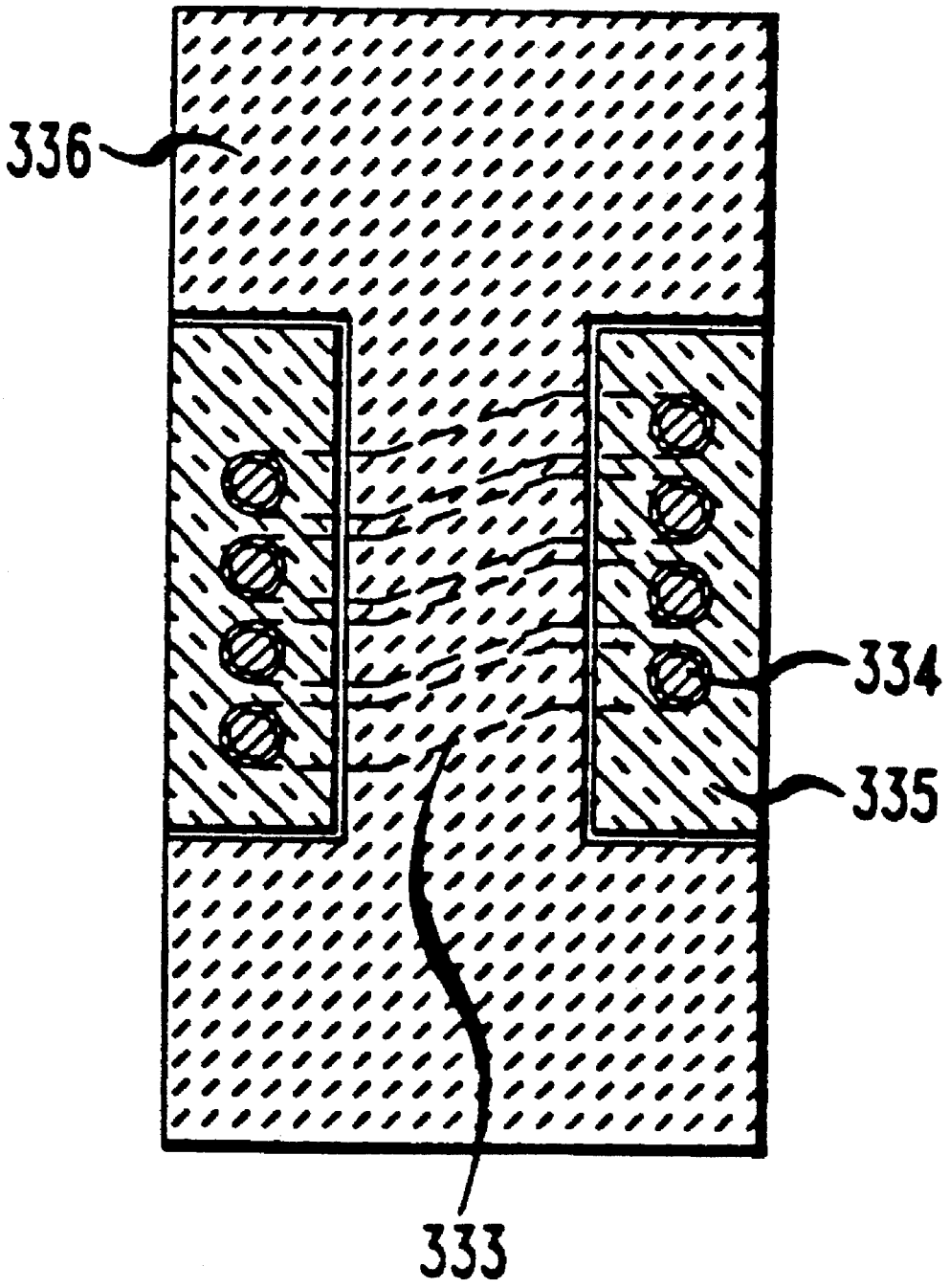

An alternative open structure magnetic device with the cross section taken in the X-Y plane is shown in FIG. 33. Conductor windings are formed from the printed conductors 333 (shown schematically) printed on insulating non-magnetic layers (not shown) and the vias 334, which are contained in the insulating non-magnetic via carriers 335. The windings surround the layered magnetic material 336.

While many specific implementations of the invention have been shown it is to be understood that many variations of this invention may be implemented by those skilled in the art without departing from the spirit and scope of the invention.

We claim:

1. A method for constructing a solid composite magnetic component comprising the steps of:

preparing a magnetic material in a ceramic material format having a first sintering rate and a first sintering temperature;

preparing an insulating non-magnetic material in a ceramic material format, with a sintering rate and sintering temperature substantially identical to the first sintering rate and first sintering temperature;

preparing apertures in the insulating non-magnetic material for accepting the magnetic material;

depositing conductors within the insulating non-magnetic material which are connected to form at least a winding to provide electromagnetic excitation of the magnetic material;

forming a composite structure of the magnetic material and the insulating non-magnetic material by adding the magnetic material to the apertures to form a structure with well defined magnetic and insulating non-magnetic regions; and co-firing the structure to form a solid composite structure.

2. A method for constructing a solid composite magnetic component as claimed in claim 4, and wherein the step of:

forming a composite structure includes providing top and bottom layers of insulating non-magnetic material to form a top and bottom structure of the component.

3. A method for constructing a solid composite magnetic component as claimed in claim 1, and further comprising the steps of:

preparing the magnetic material in a ceramic paste format;

preparing the insulating non-magnetic material in a ceramic tape format;

the step of forming the structure includes the step of layering the insulating non-magnetic material tape; and applying pressure to laminate the structure prior to the step of co-firing.

4. A method for constructing a solid composite magnetic component as claimed in claim 1, and further comprising the steps of:

preparing the magnetic material in a ceramic tape and a ceramic paste format;

preparing the insulating non-magnetic material in a ceramic tape format;

the step of forming the structure includes the step of layering the magnetic and insulating non-magnetic material; and applying pressure to laminate the structure prior to the step of co-firing.

5. A method for constructing a solid composite magnetic component comprising the steps of:

preparing a magnetic material in a ceramic material format having a first sintering rate and a first sintering temperature;

preparing an insulating non-magnetic material in a ceramic tape format with a sintering rate and sintering temperature substantially identical to the first sintering rate and first sintering temperature;

including apertures in the insulating non-magnetic material for accepting the magnetic material;

forming a structure by successive layering of the insulating non-magnetic material and adding the magnetic material to the apertures to form a first structure with well defined magnetic and insulating non-magnetic regions;

depositing conducting paths on selected layers of the insulating nonmagnetic material and joining the conducting paths to form windings encircling selected portions of the apertures containing the magnetic material;

applying pressure to laminate the first structure; and co-firing the first structure to form a solid composite structure.

6. A method for constructing a composite magnetic component as defined in claim 5;

wherein the step of preparing an insulating non-magnetic material includes the step of doping the insulating non-magnetic material with a metallic oxide material to cause it to have a sintering rate and sintering temperature substantially identical to the first sintering rate and first sintering temperature.

7. A method for constructing a composite magnetic component as defined in claim 5;

wherein the step of preparing a magnetic material includes the step of doping the magnetic material with a metallic oxide material to cause it to have a sintering rate and sintering temperature substantially identical to the sintering rate and sintering temperature of the insulating non-magnetic material.

8. A method for constructing a magnetic component as claimed in claim 5, wherein:

the magnetic and insulating non-magnetic material includes a spinel ferrite of the form $M_{1+x}Fe_{2-y}O_{4-z}$.

9. A method for constructing a solid composite magnetic component as claimed in claim 5;

wherein the step of preparing the magnetic material includes preparing it in a ceramic paste format.

10. A method for constructing a solid composite magnetic component as claimed in claim 5;

wherein the step of preparing the magnetic material includes preparing it in a ceramic tape format.

11. A method for constructing a composite magnetic component as claimed in claim 5;

wherein the step of co-firing includes the step of co-firing to a temperature of 800° to 1400° C.

12. A method for constructing a composite magnetic component as defined in claim 5 and further comprising the steps of:

doping the insulating non-magnetic material with a metallic oxide material to increase its resistivity and decrease its permeability.

13. A method for constructing a composite magnetic component as defined in claim 5 and further comprising the steps of:

constructing the conducting paths with a conductive material containing Pd which conforms to the firing and sintering characteristics of the magnetic material and the insulating non-magnetic material.

14. A method for constructing a composite magnetic component as defined in claim 5 and further comprising the steps of:

constructing the conducting paths with a conductive material containing a Pd-Ag alloy which conforms to the firing and sintering characteristics of the magnetic material and the insulating non-magnetic material.

15. A method for constructing a composite magnetic component as defined in claim 5 and further comprising the steps of:

constructing the conducting paths with a conductive material containing metallic particles and which conforms to the firing and sintering characteristics of the magnetic material and the insulating non-magnetic material.

16. A method for constructing a composite magnetic component as defined in claim 8 wherein:

the values of x, y and z may assume positive and negative numerical values.

17. A method for constructing a composite magnetic component as defined in claim 8;

wherein the M material includes at least one of the elements Mn, Mg, Ni, Zn, Fe, Cu, Co, Zr, Va, Cd, Ti, Cr and Si.

18. A method for constructing a composite magnetic component as defined in claim 5 wherein the insulating non-magnetic material is a Ni-ferrite material.

19. A method for constructing a composite magnetic component as defined in claim 5:

wherein the insulating non-magnetic material is a Zn-ferrite material.

20. A method for constructing a composite magnetic component is claim 5:

wherein the insulating non-magnetic material is a Mg-ferrite material.

21. A method for constructing a composite magnetic component as defined in claim 5:

wherein the magnetic material is a MnZn material.

22. A method for constructing a composite magnetic component as defined in claim 5:

wherein the magnetic material is a NiZn material.

23. A process for producing a solid composite magnetic component comprising at least two different materials each comprised of a ferrite matrix; wherein the ferrite materials are of the form $M_{1+x}Fe_{2-y}O_{4-z}$ comprising the steps of:

preparing a magnetic material by;

providing a first ferrite powder of a substantially MnZn ferrite composition suitable to provide a relatively high permeability in a resulting first ferrite matrix, preparing an insulating non-magnetic material by;

providing a second ferrite powder of a substantially Ni ferrite composition suitable to provide a high resistivity and a low permeability in a resulting second ferrite matrix, adding a Cu oxide to the second ferrite powder in an amount ranging from 1% mol to 10% mol of the total amount of the second ferrite powder so that the second ferrite powder has a sintering rate and sintering temperature substantially identical to that of the first ferrite powder, admixing the second ferrite powder with an organic binding material and forming the resulting mixture into a ceramic tape, defining different tape layers with specified layers having certain defined apertures;

forming a layered structure with the different tape layers in which the apertures form a geometric structure suitable for a magnetic core and in which the apertures are filled with a material comprising the first ferrite powder, laminating the layered structure by applying a pressure thereto, firing the laminated structure;

sintering the resulting structure at a temperature exceeding 800° centigrade to produce a sintered product having two ferrite matrix materials in a single composite structure;

cooling the single composite structure to form the solid composite magnetic component.

24. A process for producing a solid composite magnetic component as claimed in claim 23:

wherein the step of preparing an insulating non-magnetic material includes adding a Zr oxide to the second ferrite powder to increase its resistivity and further reduce its permeability.

25. A process for producing a solid composite magnetic component as claimed in claim 23:

wherein the step of preparing an insulating non-magnetic material includes adding a Zr oxide to the second ferrite powder to increase its resistivity and further reduce is permeability.

26. A process for producing a solid composite magnetic component as defined in claim 23, wherein the step of preparing a magnetic material includes admixing the first ferrite powder with an organic binder and forming the resulting mixture into a second ceramic tape.

27. A method for constructing a solid composite magnetic component with multilayer ceramic tape layers;

comprising the steps of:

providing a first ferrite powder of MnZn ferrite composition having a specific sintering rate and temperature;

providing a second ferrite powder of a Ni ferrite composition and further doped with copper oxide particles in an amount equaling 1–10% of the overall molar composition to introduce a liquid phase into the second ferrite material to lower its sintering temperature and modify its sintering rate so that they equal the specific sintering rate and temperature;

preparing a magnetic material comprising a binder and the first ferrite powder of a MnZn ferrite composition;

preparing an insulating non-magnetic material in the form of a ceramic tape comprising a binder and the second ferrite power of a Ni ferrite composition;

forming apertures in the insulating non-magnetic material for accepting the magnetic material;

placing pluralities of the insulating non-magnetic materials formed of ceramic tape adjacent each other at least in part in layers and inserting the magnetic material in the apertures to assemble a multilayer structure having well defined regions of high permeability and well defined regions of low permeability adjacent the regions of high permeability; and applying pressure to laminate the multilayer structure;

co-firing the laminated structure to a temperature within a range of 800 to 1400 degrees Centigrade to join the layers into a solid composite structure.

28. A method for constructing a solid composite magnetic component with multilayer ceramic tape layers as claimed in claim 27;

wherein the step of co-firing is performed within a range of 1250 to 1350 degrees centigrade.

29. A method for constructing a solid composite magnetic component with multilayer ceramic tape layers as claimed in claim 27;

and including the step of:

doping the second ferrite powder of a Ni ferrite composition with MnO to lower its permeability and conductivity.

30. A method for constructing a solid composite magnetic component with multilayer ceramic tape layers as claimed in claim 27;

and including the step of:

doping the second ferrite powder of a Ni ferrite composition with $ZrO_2$ to lower its permeability and conductivity.

31. A method for constructing a solid composite structure including at least a magnetic component comprising the steps of:

preparing a magnetic ceramic material having a first sintering rate and a first sintering temperature;

preparing an insulating non-magnetic material in a ceramic tape format, with a sintering rate and sintering temperature substantially identical to the first sintering rate and first sintering temperature;

forming a structure by successive layering of the insulating non-magnetic material and combining it with the magnetic material to form a first structure with well defined magnetic and non-magnetic regions;

printing conductors on a portion of the structure so as to magnetically engage the magnetic material;

applying pressure to laminate the structure: and co-firing the first structure to form a solid composite structure.

32. A method for constructing a solid composite structure as claimed in claim 31, and further comprising the steps of:

preparing apertures in the ceramic tape of insulating non-magnetic material for accepting the magnetic material; and printing the conductors on selected layers of the ceramic tape of insulating non-magnetic material and constructing conducting vias to interconnect conductors printed on different layers.

33. A method for constructing a solid composite structure as claimed in claim 32, and further comprising the steps of:

preparing the magnetic ceramic material in a ceramic tape format.

* * * * *